US006441710B1

(12) United States Patent
Yanagi et al.

(10) Patent No.: US 6,441,710 B1
(45) Date of Patent: Aug. 27, 2002

(54) SUPERCONDUCTING MAGNET APPARATUS AND METHOD FOR MAGNETIZING SUPERCONDUCTOR

(75) Inventors: Yousuke Yanagi, Chiryu; Tetsuo Oka, Obu; Yoshitaka Itoh, Chiryu; Masaaki Yoshikawa, Kariya, all of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/586,956

(22) Filed: Jun. 5, 2000

Related U.S. Application Data

(62) Division of application No. 08/879,040, filed on Jun. 19, 1997, now Pat. No. 6,111,490.

(30) Foreign Application Priority Data

| | | |
|---|---|---|
| Jun. 19, 1996 | (JP) | 8-180058 |
| Aug. 30, 1996 | (JP) | 8-249145 |
| Aug. 30, 1996 | (JP) | 8-249147 |
| Aug. 30, 1996 | (JP) | 8-249148 |
| Nov. 21, 1996 | (JP) | 8-327899 |

(51) Int. Cl.[7] ..... H01F 27/24
(52) U.S. Cl. ..... 335/216; 335/300
(58) Field of Search ..... 335/216, 299–300; 324/318–321; 62/51.1; 505/892–99

(56) References Cited

U.S. PATENT DOCUMENTS

| | | | | |
|---|---|---|---|---|
| 5,113,165 A | * | 5/1992 | Ackermann | 335/300 |
| 5,633,588 A | * | 5/1997 | Hommei et al. | 324/320 |
| 5,659,278 A | * | 8/1997 | Yanagi et al. | 335/216 |
| 5,686,876 A | * | 11/1997 | Yamamoto et al. | 335/216 |

FOREIGN PATENT DOCUMENTS

| | | | |
|---|---|---|---|
| JP | 5-175034 | | 7/1993 |
| JP | 6-168823 | | 6/1994 |
| JP | 7-111213 | | 4/1995 |
| JP | 9-50718 | * | 8/1995 |

OTHER PUBLICATIONS

Advances in Superconductivity X, Osamura et al., vol. 1, ISTEC, Oct. 1997.*

* cited by examiner

*Primary Examiner*—Lincoln Donovan
(74) *Attorney, Agent, or Firm*—Oblon, Spivak, McClelland, Maier & Neustadt, P.C.

(57) ABSTRACT

A cold head is disposed in an insulating container and cooled by a refrigerator. A superconductor is disposed in the insulating container, contacting the cold head, and is cooled to its superconduction transition temperature or lower by heat conduction. A magnetizing coil is disposed outside the insulating container for applying a magnetic field to the superconductor. Control is performed so that a magnetic field determined considering the magnetic field to be captured by the superconductor is applied. A pulsed magnetic field is applied to the superconductor a plurality of times. Each pulsed magnetic field is applied when the temperature of the superconductor is a predetermined temperature or lower. A maximum pulsed magnetic field is applied at least once in an initial or intermediate stage of the repeated application of pulsed magnetic fields. After that, a pulsed magnetic field equal to or less than the maximum pulsed magnetic field is applied. Pulsed magnetic fields are repeatedly applied while the temperature of the superconductor is lowered. A pulsed magnetic field is applied when the temperature To of a central portion of the superconductor is the superconduction transition temperature or lower and the temperature of a peripheral portion is higher than $T_0$. The temperature of the entire superconductor is brought close to $T_0$ to apply another pulsed magnetic field. The magnetizing coil faces at least one of two opposite sides of the superconductor to apply pulsed magnetic fields to the superconductor in its magnetization direction.

4 Claims, 30 Drawing Sheets

| TIME AFTER MAGNETIZATION | IMMEDLATELY AFTER | 1 MIN | 1 HOUR |
|---|---|---|---|
| CENTRAL PORTION OF SPECIMEM | ■ | ● | ▲ |
| PERIPHERAL PORTION OF SPECIMEM | □ | ○ | △ |

S0, S1, S2 : PENETRATING MAGNETIC FIELD
R0, R1, R2 : MAXIMUM CAPTURABLE MAGNETIC FIELD
B0, B1, B2 : CAPTURED MAGNETIC FIELD

SUPERCONDUCTING MAGNET APPARATUS AND METHOD FOR MAGNETIZING SUPERCONDUCTOR

CROSS-REFERENCE TO RELATED APPLICATIONS

This application is a divisional of U.S. patent application Ser. No. 08/879,040 filed Jun. 19, 1997, now U.S. Pat. No. 6,111,490 which claimed priority under 35 U.S.C section 119 to Japan 9-180058, application date Jun. 19, 1996.

The entire disclosure of Japanese Patent Application No. Hei 08-180058 filed on Jun. 19, 1996 including the specification, drawings and abstract is incorporated herein by reference in its entirety.

BACKGROUND OF THE INVENTION

1. Field of the Invention

The present invention relates to a superconducting magnet apparatus and a method for magnetizing a superconductor and, more particularly, to an apparatus that causes a bulk high-temperature superconductor to capture a great magnetic field and makes it possible to use the superconductor as a magnet and a method for magnetizing the superconductor.

2. Description of the Related Art

Through structure control, some high-temperature superconductors formed from, for example, yttrium (Y)-system materials, have been developed that are able to capture great magnetic fields exceeding 1 T, which is impossible for permanent magnets to capture, at a liquid nitrogen temperature level. These superconductors are capable of capturing increased magnetic fields if they are cooled to lower temperatures. Moreover, since property improvements are expected due to developments in the field of materials, use of the superconductors as strong magnets is lately considered.

There are mainly two methods for magnetizing a bulk superconductor: a so-called FC (Field Cooling) method that cools a bulk superconductor to the superconduction transition temperature Tc of the superconductor or a lower temperature while applying a magnetic field to the superconductor; and a so-called ZFC (Zero Field Cooling) method that cools a bulk superconductor to its superconduction transition temperature or lower and then applies a magnetic field to it from the outside so that the magnetic field penetrates into the superconductor. In either method, it is necessary to apply a magnetic field at least equal to a magnetic field that the superconductor is desired to capture, to the superconductor at least once. Furthermore, it is necessary to maintain the temperature of the superconductor at a temperature equal to or lower than the temperature at the time of magnetization, in order to maintain the magnetic field captured by the superconductor.

The FC magnetization method has normally been employed to cause a high-temperature superconductor to capture a magnetic field for the purpose of, for example, evaluating the characteristics of the superconductor. For example, a technology disclosed in Japanese Patent Laid-Open No. Hei 7-111213 uses the FC method to cause a superconductor to capture a magnetic field, and produces a magnet by combining the superconductor and a coil.

In the ZFC magnetization method, on the other hand, after a superconductor is cooled, an external magnetic field is slowly applied to the superconductor and then slowly reduced to zero. Since the superconductor has already been cooled to the superconducting state at the time of application of the external magnetic field, a certain amount of the external magnetic field applied is expelled. Therefore, the ZFC method requires application of a greater magnetic field than the FC method. This is part of the reason why if a steady magnetic field is to be used for magnetization, the FC method, not the ZFC method, is normally employed for practical purposes.

Besides the foregoing methods, which simply turns a bulk superconductor directly into a magnet, another magnetization method is disclosed in Japanese Patent Laid-Open No. Hei 5-175034. In this method, a bulk superconductor is formed into the shape of a coil, and the coil-shaped superconductor is magnetized by supplying electricity to the superconductor.

The conventional FC method requires that a steady magnetic field be applied to a superconductor while the superconductor is being cooled. However, the steady magnetic field can be produced only in a small magnitude if a simply-constructed magnetic field generator is employed. Therefore, as long as a simple generator is employed in the FC method, it is normally impossible to cause a superconductor to capture a magnetic field that considerably exceeds the magnetic field of a normal permanent magnet.

A Nb—Ti superconducting coil can be used in the FC method to produce a great steady magnetic field to be applied to a superconductor. However, since the Nb—Ti superconducting coil needs to be cooled to a very low temperature, the entire apparatus for performing this method normally needs to be increased in size and complexity in order to cause the superconductor to capture a great magnetic field.

Furthermore, since the superconductor must be cooled while being subjected to a magnetic field, the FC method requires a long time for magnetization. In addition, after magnetization, the superconductor must be continually cooled even when installed for use, thus considerably limiting the location of use. Therefore, the FC method is not suitable for the purpose of using a superconductor as a strong magnet disposed inside an apparatus or thy like.

If the ZFC method uses a steady magnetic field, the method suffers from problems similar tn those of the FC method. Moreover, since the ZFC method requires a greater applied magnetic field than the FC method, the problems become more remarkable in the ZFC method.

In a method wherein a bulk superconductor is formed into the shape of a coil as disclosed in Japanese Patent Laid-Open No. Hei 5-175034, the working on the superconductor becomes considerably complicated and, if a ceramic superconductor is used, the working becomes very difficult and costly. Furthermore, deterioration of the material during the working is likely, thereby making it difficult to produce a superconductor having stable properties.

According to the foregoing conventional methods, even though bulk superconductors with good properties are available, it is difficult to use such bulk superconductors as magnets that produce great magnetic fields in various appliances and machines.

Japanese Patent Laid-Open No. Hei 6-168823 describes a method that applies pulse-like magnetic fields to a superconductor instead of a steady magnetic field. This method is very useful to magnetize a superconductor using a simple coil device.

SUMMARY OF THE INVENTION

The present invention is directed to an improvement of a superconducting magnet apparatus for pulsed magnetization and a pulsed magnetization method that are described in Japanese Patent Laid-Open No. Hei 6-168823. It is an object of the present invention to provide simple apparatus and method for causing a bulk superconductor to capture a conventionally unachievable high magnetic field, without performing machining or another working process on the superconductor, thereby making it possible to use a superconductor as a magnet in various appliances for various applications.

To achieve the aforementioned object of the invention, the present inventors have attempted to improve the pulsed magnetization method. It is conventionally considered that in the pulsed magnetization method, the space between a superconductor and a magnetizing coil needs to be minimized because when a magnetic field is applied to magnetize a superconductor that has been cooled without being magnetized, the superconductor exhibits a characteristic of expelling the entering magnetic field. However, it is desirable that the magnetizing coil and the superconductor be more freely arranged in order to use the superconductor as a magnet in various apparatuses. Accordingly, in view of designing a magnet apparatus in various arrangements with an increased freedom, the present inventors considered and examined various conditions, such as the arrangement of a superconductor and a magnetizing coil, the magnitude of pulsed magnetic fields, duration of application of pulsed magnetic fields, the manner of applying pulsed magnetic fields and the like.

According an aspect of the present invention, there is provided a method for magnetizing a superconductor which method includes cooling a superconductor, and magnetizing the superconductor by supplying a magnetizing coil with a pulsed current whose peak value is controlled beforehand, and by causing a magnetic field produced by the magnetizing coil to penetrate into the superconductor and causing the superconductor to capture a magnetic field.

The magnetic field captured by a superconductor is dependent on the critical current density Jc of the superconductor and the configuration of the superconductor, and there exists an upper limit (maximum captured magnetic field) of the magnetic field captured by the superconductor under certain conditions. If a peak value of a pulsed current to be supplied to the magnetizing coil is small, the magnetic field that penetrates into the superconductor becomes also small. In such a case, an insufficient captured magnetic field may result although a maximum captured magnetic field is desired. However, if a peak value of a pulsed current to be supplied to the magnetizing coil is controlled beforehand, the magnetic field that penetrates into the superconductor is correspondingly controlled. Therefore, it becomes possible for the superconductor to capture a magnetic field comparable to a desired captured magnetic field.

According to another aspect of the present invention, there is provided a method for magnetizing a superconductor which method includes cooling a superconductor, and magnetizing the superconductor by energizing a magnetizing coil that is disposed facing at least one of two opposite sides of the superconductor in a direction in which the superconductor is to be magnetized, and by causing a magnetic field produced by the magnetizing coil to penetrate into the superconductor and causing the superconductor to capture a magnetic field.

Since the magnetizing coil faces at least one of two opposite sides of the superconductor where magnetization surfaces exit, local magnetization of the superconductor can be achieved by disposing the magnetizing coil facing only a desired magnetization surface, and then performing pulsed magnetization. If uniform magnetization of the entire superconductor is desired, the magnetizing coil is disposed facing the magnetization surfaces of the entire superconductor to perform pulsed magnetization. Thus, this method is able to perform pulsed magnetization locally or entirely on the superconductor.

According to still another aspect of the present invention, there is provided a superconducting magnet apparatus having a superconductor disposed in an insulating container, a refrigerator provided with a cold head that thermally contacts the superconductor and cools the superconductor, and a magnetizing coil that applies a pulsed magnetic field to the superconductor. An energization device is provided for energizing the magnetizing coil by a pulsed current.

Since the superconductor is cooled by the refrigerator provided with the cold head, the superconducting magnet apparatus is able to set the temperature of the superconductor to be reached by cooling to any desired temperature, unlike an apparatus that uses a coolant, such as liquid nitrogen or the like, to cool a superconductor. Normally, the properties of superconductors are affected by the temperature of the superconductors. Therefore, the setting of the superconductor temperature to any temperature makes it possible to produce superconducting magnets having various properties.

According to a further aspect of the present invention, there is provided a superconducting magnet apparatus having a superconductor disposed in an insulating container, a cooler device for cooling the superconductor, and a magnetizing coil that applies a pulsed magnetic field to the superconductor. The magnetic coil is disposed outside the insulating container. Energization device is provided for energizing the magnetizing coil by a pulsed current.

Since the magnetizing coil for applying a pulsed magnetic field to superconductor is disposed outside the insulating container containing the superconductor, the superconductor is not affected by heat generated from the magnetizing coil during magnetization performed by supplying the pulsed current to the coil; that is, a rise of the temperature of the superconductor caused by an external factor is avoided. Therefore, it becomes possible to perform further stable pulsed magnetization leading to stable properties of the superconductor. Furthermore, the insulating container containing a superconducting magnet; that is, the superconductor that has captured a magnetic field can easily be separated from the magnetizing coil, a magnetizing power source and the like, so the portability of the superconducting magnet is improved.

According to a still further aspect of the present invention, there is provided a superconducting magnet apparatus having a superconductor disposed in an insulating container, a cooler device for cooling the superconductor, and a magnetizing coil that applies a pulsed magnetic field to the superconductor. A heater device is provided for heating the superconductor.

Since the heater device for heating the superconductor is provided, the apparatus is able to achieve any desired temperature distribution in the superconductor. By performing pulsed magnetization a plurality of times with various temperature distributions in the superconductor, the superconductor can be caused to capture a maximum possible magnetic field.

According to a yet further aspect of the present invention, there is provided a superconducting magnet apparatus having a superconductor disposed in an insulating container, a cooler device for cooling the superconductor, and a magnetizing coil that applies a pulsed magnetic field to the superconductor. The magnetizing coil is disposed facing at least one of two opposite sides of the superconductor in a direction in which the superconductor is to be magnetized.

Since the magnetizing coil faces at least one of two opposite sides of the superconductor where magnetization surfaces exit, local magnetization of the superconductor can be achieved by disposing the magnetizing coil facing only a desired magnetization surface, and then performing pulsed magnetization. If uniform magnetization of the entire superconductor is desired, the magnetizing coil is disposed facing the magnetization surfaces of the entire superconductor to perform pulsed magnetization. Thus, this apparatus is able to perform pulsed magnetization locally or entirely on the superconductor.

BRIEF DESCRIPTION OF THE DRAWINGS

The foregoing and further objects, features and advantages of the present invention will become apparent from the following description of preferred embodiments with reference to the accompanying drawings, wherein like numerals are used to represent like elements and wherein:

FIG. 15(*b*) is a diagram indicating the distributions of the temperature, the penetrating magnetic field, the maximum capturable magnetic field, the captured magnetic field of the superconductor according to the fourth embodiment, at the time of the second-application of a pulsed magnetic field;

FIG. 16(*b*) is a diagram indicating the distribution of the captured magnetic field that changed over time according to the fourth embodiment;

FIG. 18(*b*) is a diagram indicating the distributions of the temperature, the penetrating magnetic field, the maximum capturable magnetic field, the captured magnetic field of the superconductor according to the fifth embodiment, at the time of the second application of a pulsed magnetic field;

FIG. 23(*b*) is a diagram indicating the distribution of the captured magnetic field that changed over time according to the eighth embodiment;

FIG. 32(*b*) illustrates an arrangement according to the eleventh embodiment wherein superconductors are used as a magnetic coupling;

DETAILED DESCRIPTION OF PREFERRED EMBODIMENTS

Preferred embodiments of the present invention will be described in detail hereinafter with reference to the accompanying drawings.

First Embodiment

Figure 1:
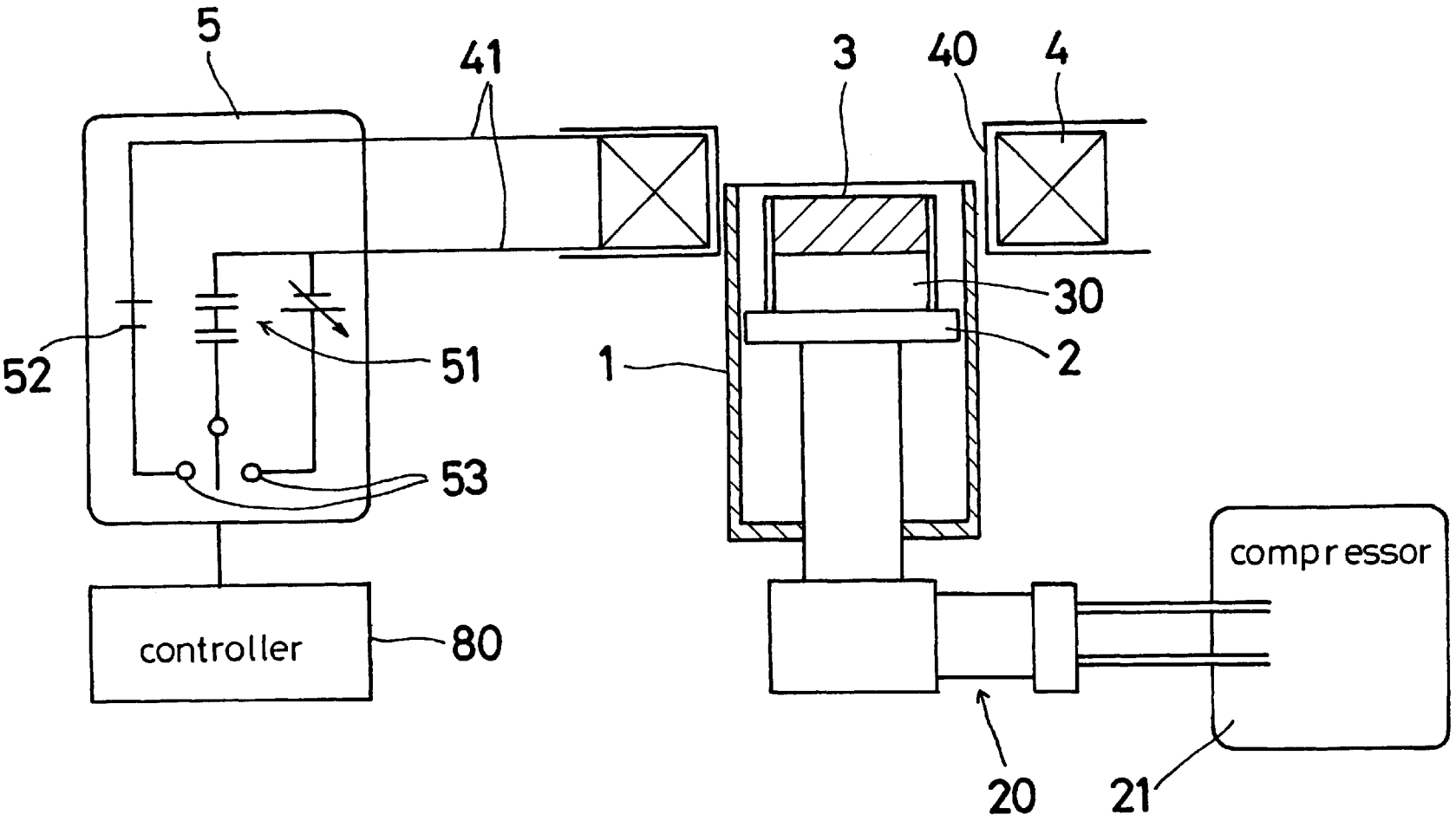
FIG. 1 is a block diagram illustrating a basic construction of a superconducting magnet apparatus and a method for magnetizing a superconducting magnet according to a first embodiment.

A superconducting magnetic apparatus and a method for magnetizing the superconducting magnetic apparatus according to a first preferred embodiment of the invention employ a construction as shown in FIG. 1. A cold head 2 is disposed in an insulating container 1 and cooled by a refrigerator 20. A superconductor 3 is disposed in the insulating container 1, contacting the cold head 2. Through heat conduction, the superconductor 3 is cooled to its superconduction transition temperature or lower. A magnetizing coil 4 is disposed outside the insulating container 1 for applying a magnetic field to the superconductor 3. A pulse power source 5 supplies the magnetizing coil 4 with a pulsed current that is controlled by a controller 80 so that a magnetic field determined considering the magnetic field to be captured by the superconductor 3 is applied to the superconductor 3.

The insulating container 1 is vacuum-evacuated, thereby heat-insulating the superconductor 3 and the cold head 2 from the outside of the insulating container 1 as indicated in FIG. 1.

Figure 2:
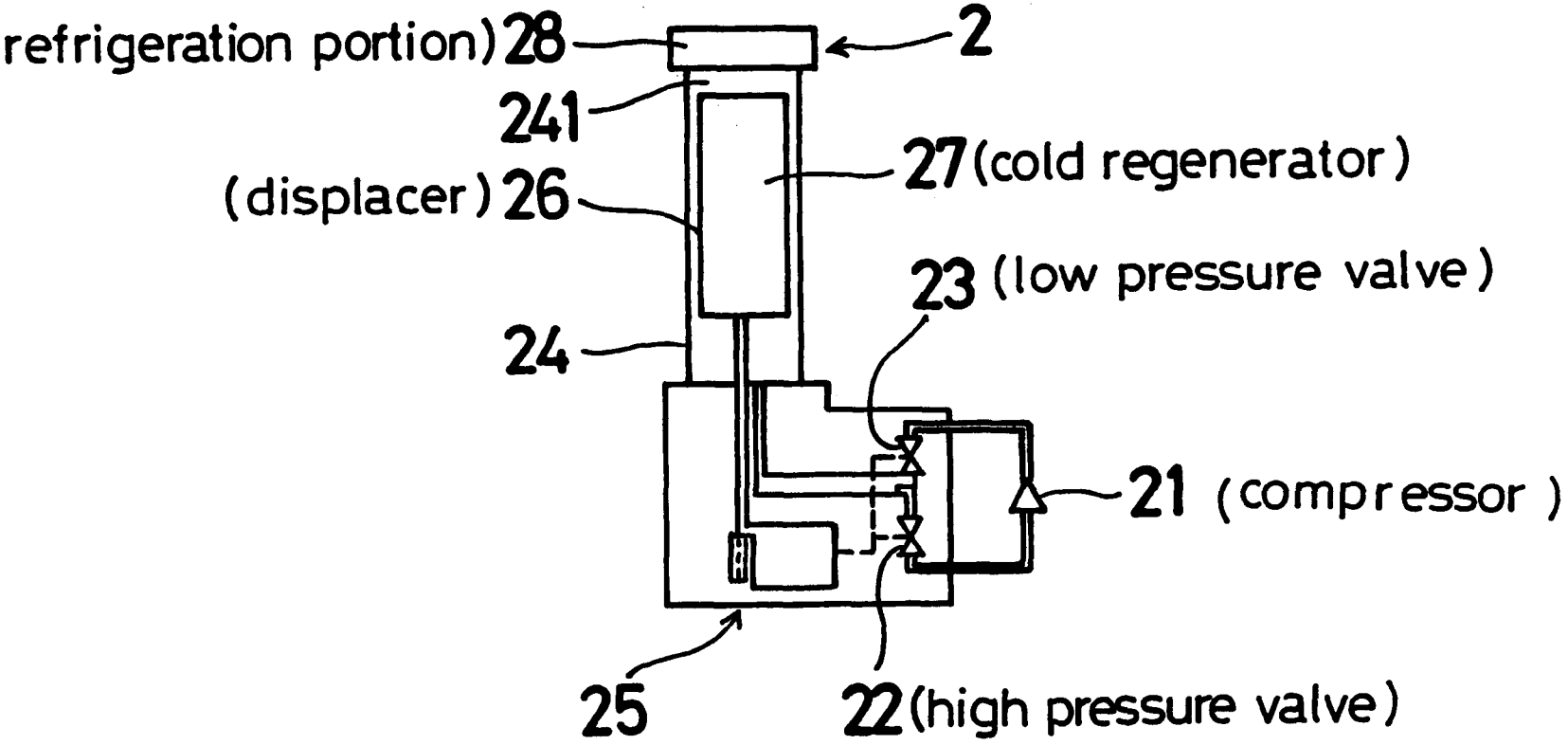
FIG. 2 is a block diagram of a refrigerator used according to the first embodiment.

The refrigerator 20 is formed by a GM refrigerator employing a cold-regenerative refrigerating cycle that was developed by Gifford McMahon, as shown in FIG. 2. The refrigerator 20 has a compressor 21 for compressing air, a high pressure valve 22 that communicates with an outlet of the compressor 21, a low pressure valve 23 that communicates with an inlet of the compressor 21, a displacer 26 formed as a piston disposed in a cylinder 24 for reciprocation and driven by a drive mechanism 25 made of a stepping motor and a crank, a cold regenerator 27 that communicates with the cylinder 24 and also communicates with the high pressure valve 22 and the low pressure valve 23, and a refrigerating portion 28 formed between the cold regenerator 27 and a chamber 241 of the cylinder 24. The refrigerating portion 28 forms the cold head 2.

Figure 3:
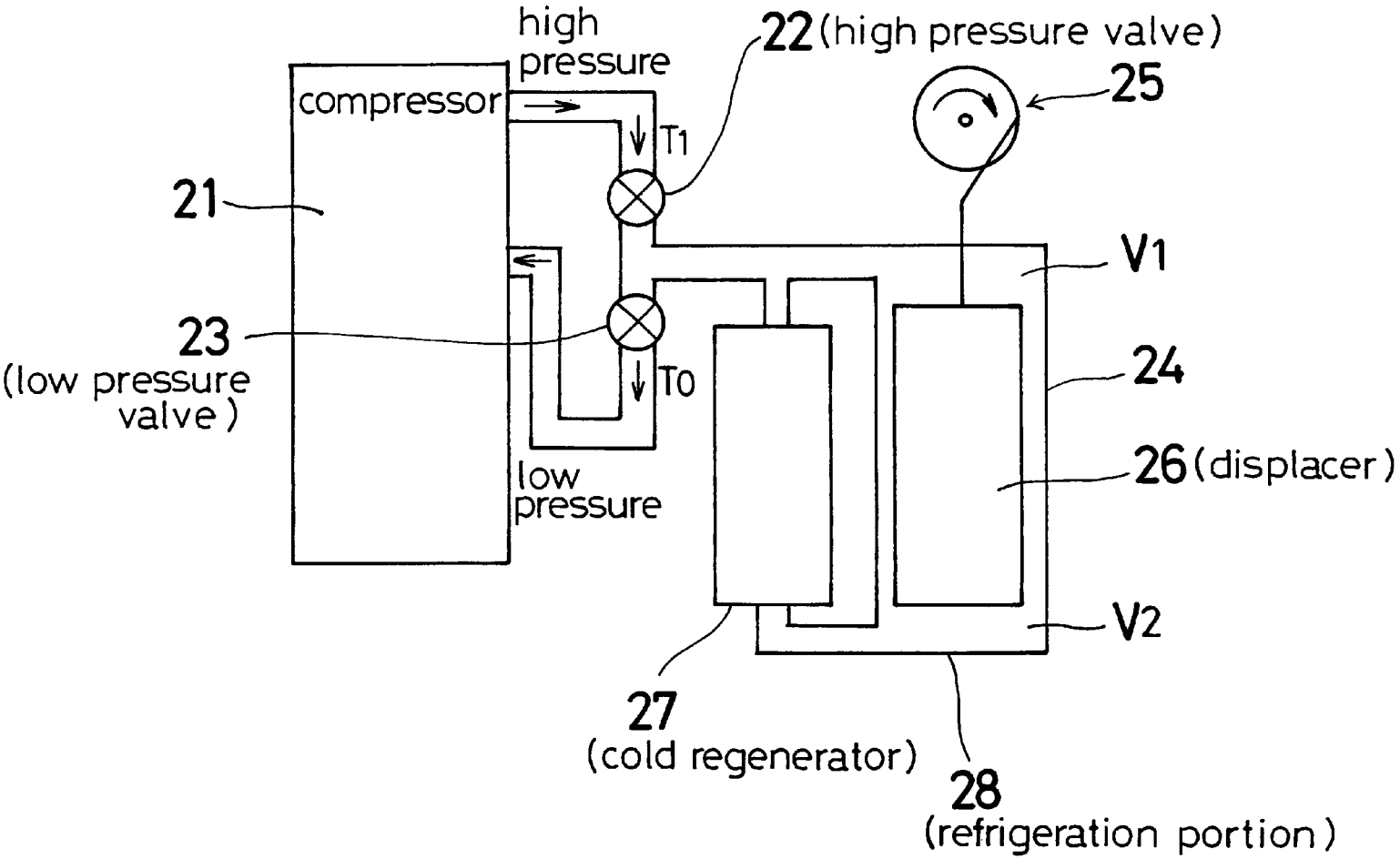
FIG. 3 is a block diagram illustrating the operation principle of the refrigerator according the first embodiment.

FIG. 3 illustrates the principle of operation of the refrigerator 20. The displacer 26 is reciprocated inside the cylinder 24 by the stepping motor at a rate of several tens of revolutions per minute. The high pressure valve 22 and the low pressure valve 23 are open-close controlled synchronously with the reciprocation of the displacer 26.

When the displacer 26 is at a lower position in FIG. 3, the high pressure valve 22 opens to allow high pressure air to enter an upper space V1 over the displacer 26. Subsequently the displacer 26 rises so that air moves into a lower space V2 while maintaining the pressure. Since the lower space is at a lower temperature, the air contracts so that an extra amount of air is introduced.

When the displacer 26 rises approximately to a highest position, the high pressure valve 22 is closed and the low pressure valve 23 is opened, so that air moves to the lower pressure side and expands, thus achieving refrigeration in the lower space V2 currently having a maximum capacity V. After the displacer 26 is lowered to discharge air from the lower space V2, the low pressure valve 23 is closed and the high pressure valve 22 is opened, thus completing one cycle.

The refrigerator 20 is a single-stage GM refrigerator with a refrigeration output of 100 W at 80 K. The lowest temperature achieved by the refrigerator alone is 25 K. In an arrangement according to this embodiment wherein the refrigerator 20 is combined with the superconductor 3, the coil 4 and the cold head 2, a lowest temperature of 30 K was achieved.

The superconductor 3 is placed on a copper block 30 placed on an upper surface of the cold head 2 formed by the refrigerating portion 28 of the refrigerator 20. The copper block 30 has a sufficient thickness. The cold head 2 is provided with a winding of heater wire. By temperature control using the heater wire, the cold head temperature can be maintained at a desired temperature down to the lowest possible temperature.

As the superconductor 3, a yttrium (Y)-system molten bulk having an outside diameter of 35 mm and a thickness of 14 mm was formed according to the first embodiment as follows. A material powder was prepared by weighing out fine powder of $YBa_2Cu_3O_7$-x and fine powder of $Y_2BaCuO_5$ at a mole ratio of 3:2 and thoroughly mixing the fine powder with 0.5 wt.% of Pt. The material powder was then pressed into a cylindrical shape and then heat-treated by a so-called molten method.

The superconductor captured a maximum magnetic field of 0.5 T when magnetized in a static magnetic field of 1 T while being cooled.

The pulse power source 5 releases the charge from a capacitor 51 and allows current to flow only in one direction through rectification by a diode 52, as shown in FIG. 1. The greatest possible output current of the power source 5 is 10,000 ampere (A).

The magnetizing coil 4 has 50 winding turns, and is fixed inside a bobbin having an inside diameter of 45 mm and an outside diameter of 60 mm, by impregnation with resin. The magnetizing coil 4 is connected to terminals 53 of the pulse power source 5 by current supply wires 41 for supplying pulsed current to the coil.

Figure 4:
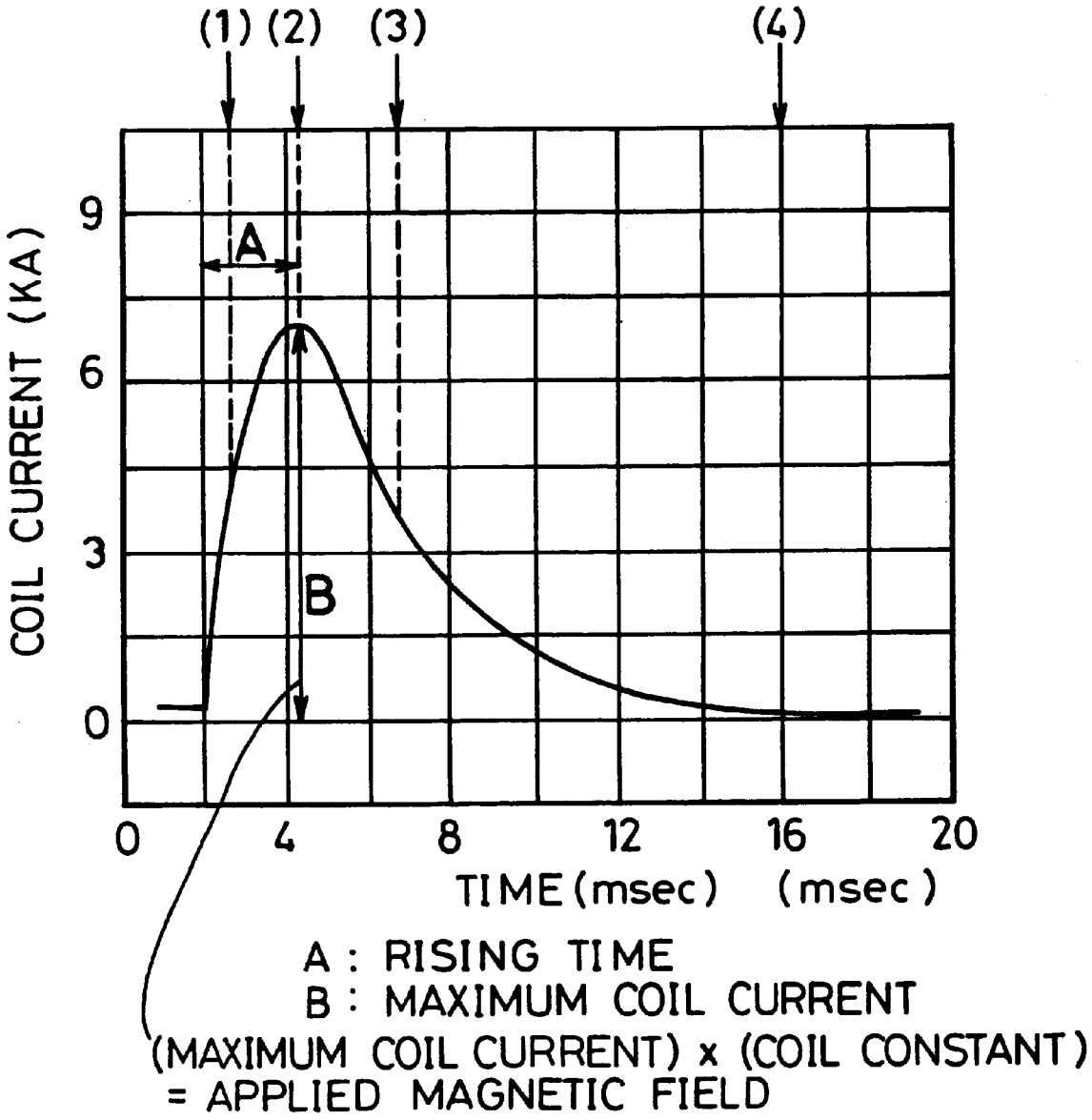
FIG. 4 is a graph showing an example of the waveform of current used to energize a magnetizing coil according to the first embodiment, the graph being used to define the magnetic field to be applied.

The magnetic field produced by a magnetizing coil per unit current value of the current flowing therethrough can be calculated based on the configuration of the coil. Therefore, the magnetic field produced can be determined by measuring the current that flows through the coil. The magnetizing coil 4 produces a magnetic field of 10 T in a central portion of the coil when energized with a current of 10,000 ampere (A) In pulsed magnetization, a current flows only instantaneously through the magnetizing coil; that is, the current value reaches the maximum in a rising time A immediately after energization starts, and then quickly returns to zero, as indicated in FIG. 4. More specifically, the magnetizing coil 4 produces a magnetic field only for a very short time of pulsed magnetization, and the produced magnetic field changes over time in accordance with changes in the value of current through the coil. Therefore, the magnetic field produced by the magnetizing coil at the time of the maximum pulsed current indicated by line B in FIG. 4 was defined as the applied magnetic field of the superconductor 3 in the experiments according to the first embodiment.

An experiment for determining an optimal applied magnetic field to cause the superconductor 3 to capture a great magnetic field according to the first embodiment will be described below. The applied magnetic field is determined by the magnitude of pulsed current supplied to the magnetizing coil 4. Therefore, the pulsed current supplied to the magnetizing coil 4 from the pulse power source 5 was varied to various magnitudes to magnetize the superconductor 3, and the captured magnetic fields corresponding to the various pulsed current magnitudes were compared. This experiment was performed while the temperature of the superconductor was maintained as 77 K, which was the same as the liquid nitrogen temperature.

Figure 5:
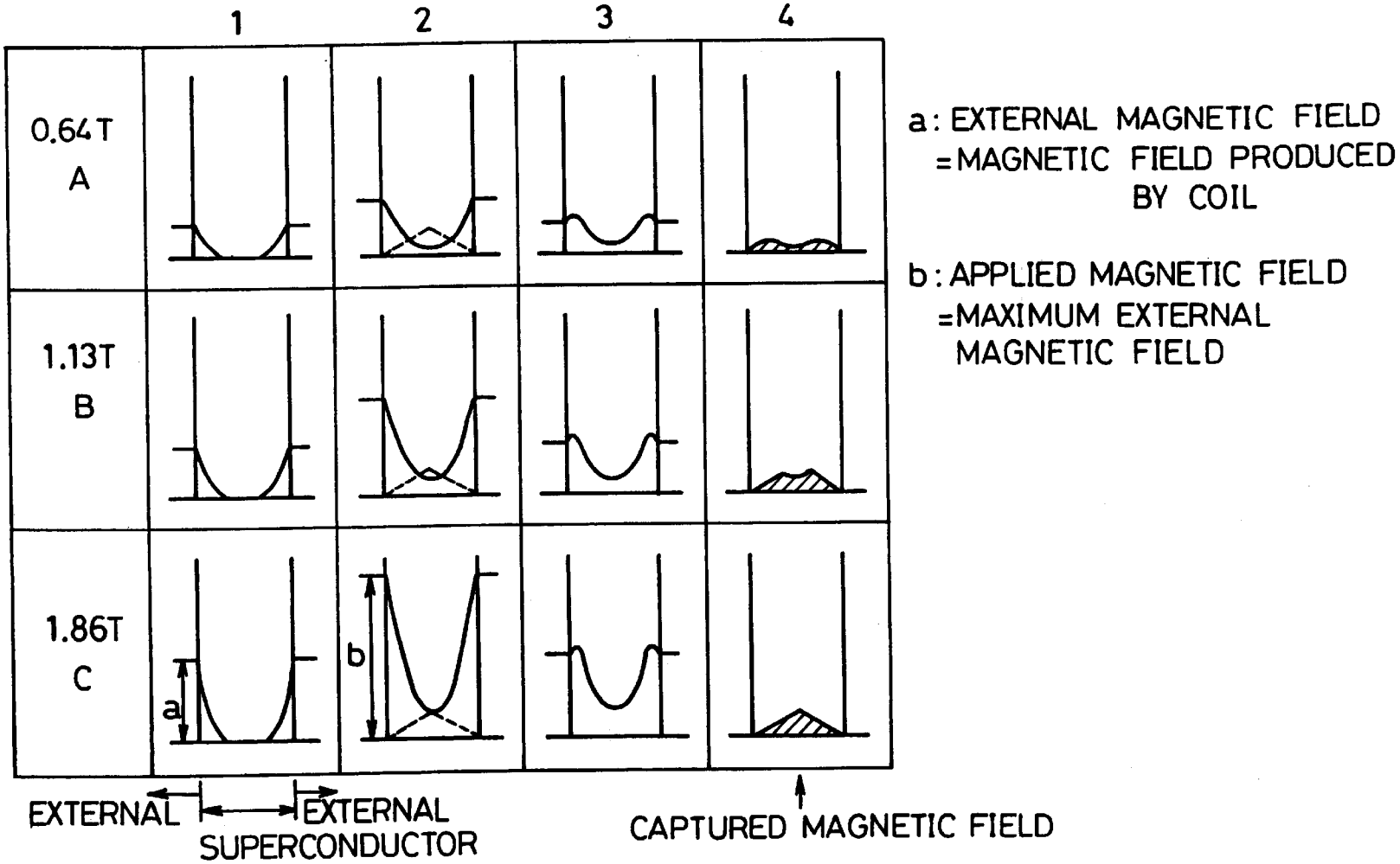
FIG. 5 is a diagram indicating the magnetic field distribution inside the superconductor at various time points during the pulsed magnetization of the superconductor according to the first embodiment.

FIG. 5 indicates the distribution of magnetic field inside the superconductor 3 when magnetic fields of 0.64 T (A), 1.13 T (B) and 1.86 T (C) were applied to the superconductor 3 for magnetization. The magnetic field distribution was detected at the various time points during occurrence of a pulsed magnetic field as indicated in FIG. 4; that is, a time point (1) during the rise, a time point (2) at the peak, a time point (3) during the fall, and a time point (4) after the fall was completed.

As indicated in FIG. 5, the pulsed magnetic field applied to an external surface of a superconductor (that is, the maximum magnetic field produced by the magnetizing coil) needs to be sufficiently great in magnitude in order for the magnetic field to penetrate sufficiently into the superconductor, because during pulsed magnetization, a force constantly occurs relative to the magnetic flux penetrating into the superconductor in such a direction that the advance of the magnetic flux is impeded; that is, the applied magnetic field is considerably blocked. In the cases of the diagrams A and B of FIG. 5, the magnetic field penetrating into a central portion of the superconductor was insufficient so that the magnetic field captured by the superconductor was insufficient compared with the maximum magnetic field possible to be captured based on the properties of the superconductor.

The superconductor 3 captured a sufficiently great magnetic field compared with the maximum capturable magnetic field of the superconductor when a magnetic field of 1.86 T was applied as indicated in FIG. 5. As can be seen from the diagrams of FIG. 5, the maximum capturable magnetic field can actually be captured by applying an external magnetic field such that a central portion of the superconductor 3 where the maximum capturable magnetic field is greatest in the superconductor is penetrated by a magnetic field that is greater than the maximum capturable magnetic field in the central portion.

Figure 6A:
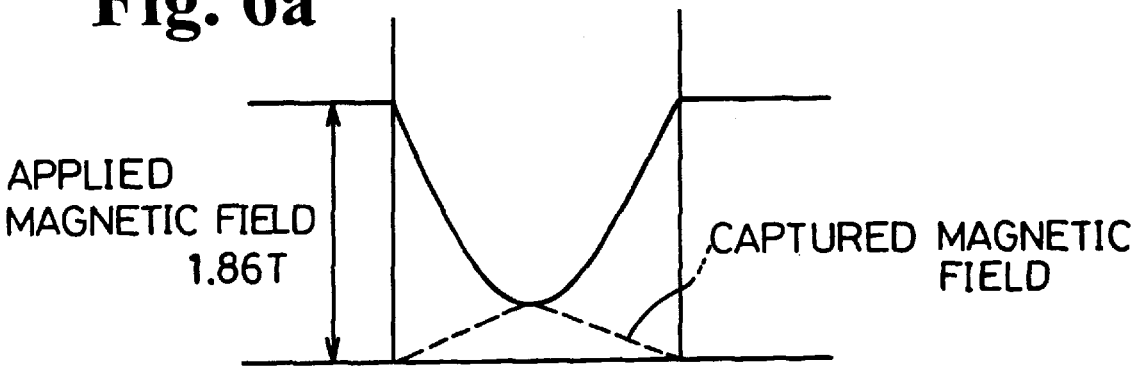
FIGS. 6*a* and 6*b* are diagrams indicating the relationship between the applied magnetic field and the magnetic field captured by the superconductor according to the first embodiment.
Figure 6B:
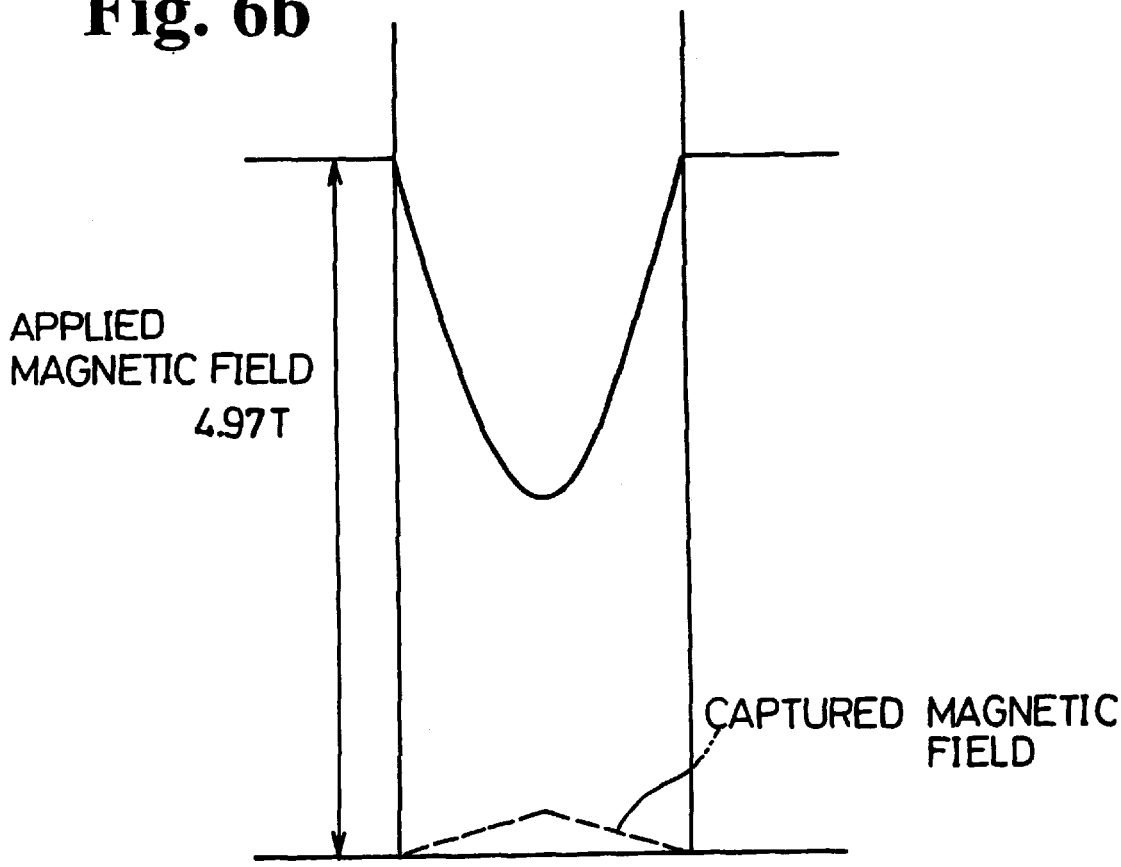

FIG. 6*a* indicates the captured magnetic field of the superconductor 3 achieved by applying a magnetic field of 1.86 T and FIG. 6*b* indicates further increased magnetic field of 4.97 T to the superconductor 3. As can be seen from FIGS. 6*a* and 6*b*, if the superconductor 3 receives application of a magnetic field greater than necessary, the captured magnetic field decreases. This can be explained as follows. In the case of the applied magnetic field of 4.97 T, the superconductor 3 was penetrated by a magnetic field far greater than the capturable magnetic field, so that the movement of the increased magnetic flux caused considerable heat generation inside the superconductor 3. Due to the thus-increased interior temperature, the force to retain magnetic flux decreased.

An optimal pulse width of the pulsed current will be discussed below.

Variations in the pulsed magnetization characteristics dependent on the pulse width and the coil configuration will be discussed. If a large-capacity capacitor is used in the pulse power source, the magnitude of magnetic field produced can be controlled by the charged voltage of the capacitor. If the same magnetizing coil is used, the produced pulsed magnetic field increases proportionally to increases in the charged voltage. However, the pulse width remains substantially unchanged.

Figure 7:
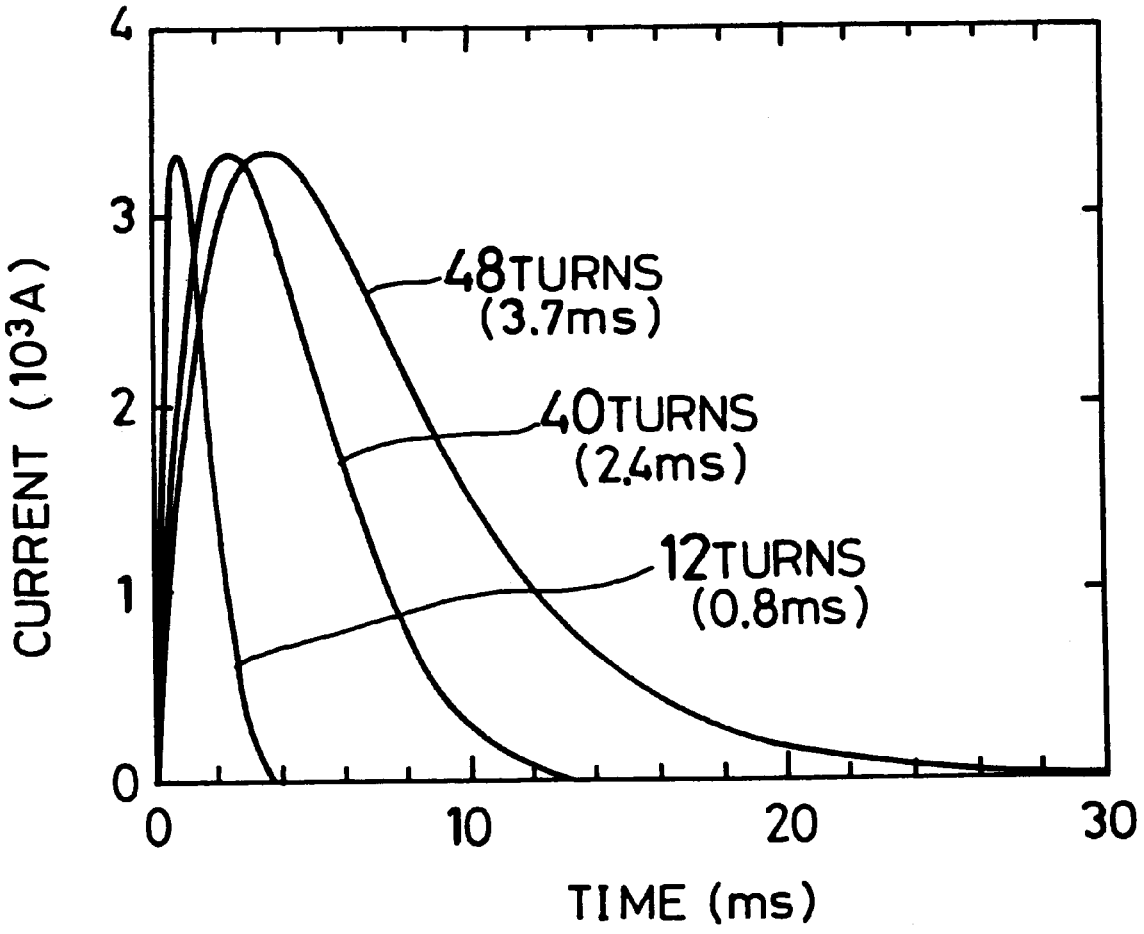
FIG. 7 is a graph indicating the relationship between the number of turns of magnetizing coils and the time of rise of pulsed current according to the first embodiment.

The pulse width increases if the number of turns of the magnetizing coil is increased or if the inside diameter of the magnetizing coil is increased. FIG. 7 indicates the waveforms of pulsed current through typical three types of magnetizing coils that were actually produced. Using the magnetizing coils, their effects on the magnetization characteristics of the superconductor were investigated.

Magnetizing coils having the same inside diameter but varying in number of winding turns were used to magnetize superconductors with pulsed magnetic fields rising at various time points. Results were that within the pulse rising time range of 0.8 msec to 2.4 msec, the magnetization characteristics remained substantially the same regardless of different pulse widths.

In an experiment where magnetizing coils having inside diameters of 35 mn and 55 mn and having the same number of winding turns were used to magnetize superconductors having an outside diameter of 34 mm, no difference was observed in the applied magnetic field-dependency of the captured magnetic field.

From the experiment results, it is found that the captured magnetic field of a superconductor provided by pulsed magnetization is determined solely by the magnitude of the magnetic field applied to the superconductor regardless of the pulse width or the configuration of the magnetizing coil.

To determine optimal magnetizing conditions according to the first embodiment, it was investigated how the captured magnetic field distribution changes as the applied magnetic field is varied. For comparison with the aforementioned conventional art, the FC and ZFC magnetizing methods and the pulsed magnetization according to the first embodiment were performed to magnetize the same superconductors at 77 K, i.e., the temperature of the liquid nitrogen, with the applied magnetic fields varied. After the magnetization, the captured magnetic fields were measured and compared.

Figure 8:
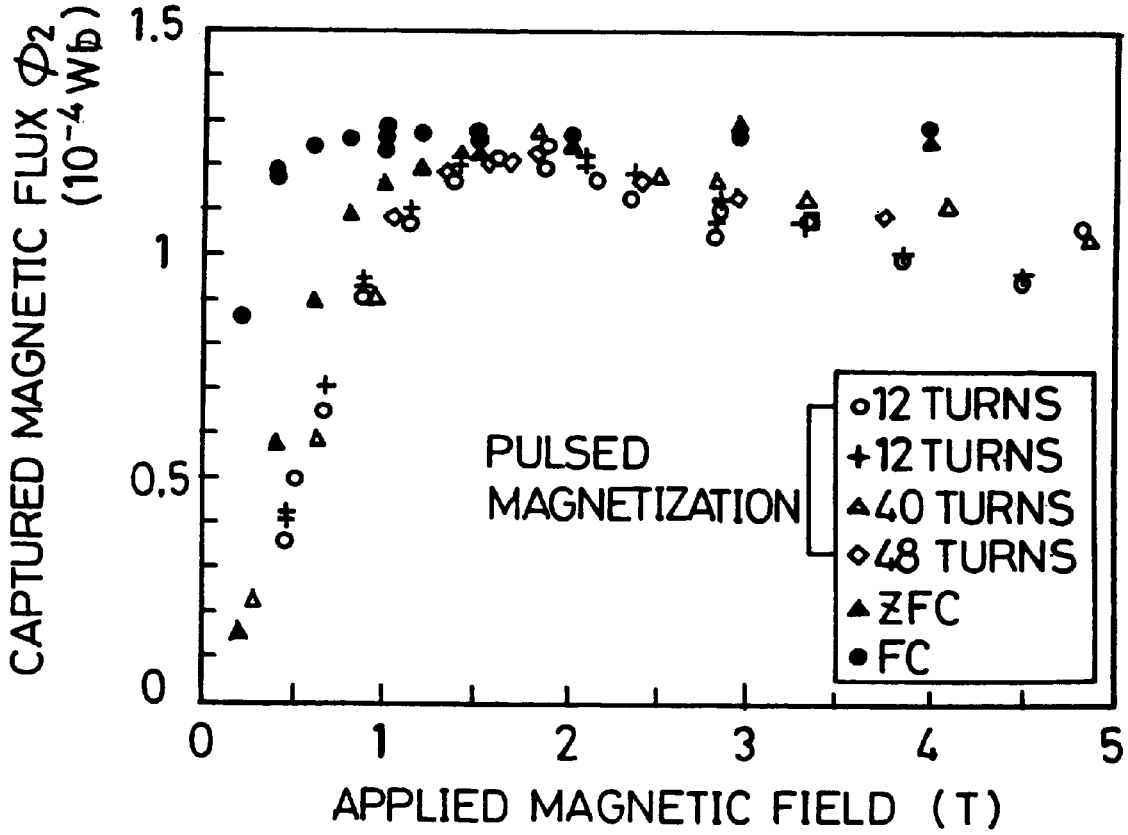
FIG. 8 is a graph indicating the relationship between the applied magnetic field and the magnetic field captured by the superconductor (the total amount of magnetic field captured) according to the first embodiment.

For comparison by the characteristics of the entire body of each specimen superconductor, the magnitude of magnetic field captured at various points on each specimen was measured by scanning a magnetic field sensor over the specimen surface, and the total amount of magnetic flux captured by each specimen was determined. Measurements of the captured magnetic flux of the same specimens magnetized. by various applied magnetic fields were plotted, producing a graph as shown in FIG. 8.

Through these experiments, it is found that in pulsed magnetization, an optimal applied magnetic field, for example 1.9 T, exists, and that if an applied magnetic field is greater than the optimal value, the captured magnetic field may decrease. Therefore, if a superconductor with a great captured magnetic field is desired, it is necessary to determine an optimal applied magnetic field for the superconductor beforehand by measuring the applied magnetic field-dependency of the captured magnetic field of the superconductor.

However, for some applications, a superconductor may be magnetized by an applied magnetic field that is greater than the applied magnetic field that causes the superconductor to capture a greatest magnetic field. The captured magnetic field of a superconductor decreases due to so-called creep where the captured magnetic field decreases at a logarithmically constant rate immediately after magnetization. Although the decrease in the captured magnetic field becomes practically ignorable a certain amount of time after magnetization, the relative decrease from the captured magnetic field occurring immediately after magnetization is smaller in a method wherein a superconductor is magnetized by an applied magnetic field exceeding the applied magnetic field that causes the superconductor to capture a greatest magnetic field, than in other magnetizing methods. Therefore, for applications where safety or reliability is more important than the intensity of captured magnetic field, it may be useful to magnetize a superconductor by an applied magnetic field exceeding the applied magnetic field that causes the superconductor to capture a greatest magnetic field.

A method for magnetizing a superconducting magnet apparatus according to the first embodiment will be described below.

First, a superconductor 3 is cooled to its superconduction transition temperature or lower on the copper block 30 by the cold head cooled by the refrigerator 20. After the temperature becomes sufficiently steady, a pulsed current similar to that indicated in FIG. 4 is supplied from the pulse power source 5 to the magnetizing coil 4, thereby applying a magnetic field to the superconductor 3.

The superconductor 3 becomes a magnet by capturing a magnetic field during the magnetic field application, and retains a substantially constant magnetic field despite a slight reduction in the produced magnetic field due to the magnetic flux creep. The superconducting magnet may be disconnected from the pulse power source 5 by removing the current supply wires 41 from the terminals 53 if necessary. Furthermore, it is also possible to re-magnetize the superconducting magnet, for example in order to change the produced magnetic field.

The characteristics of a superconducting magnet apparatus that was magnetized by the method described above are as follows.

Figure 9:
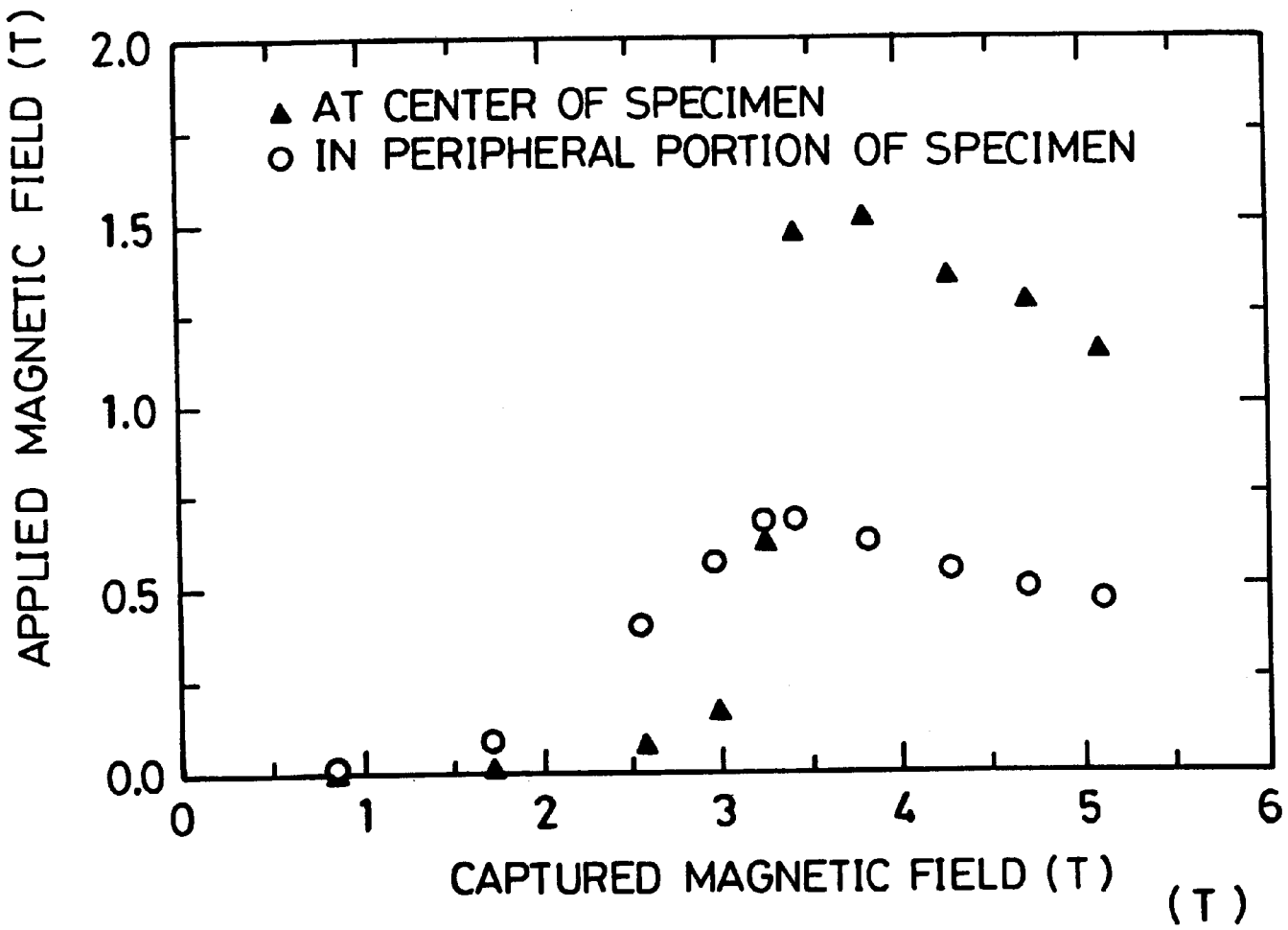
FIG. 9 is a graph indicating the applied magnetic field-dependency of the captured magnetic field; that is, the total amount of magnetic field captured by the superconductor, according to the first embodiment.
Figure 10:
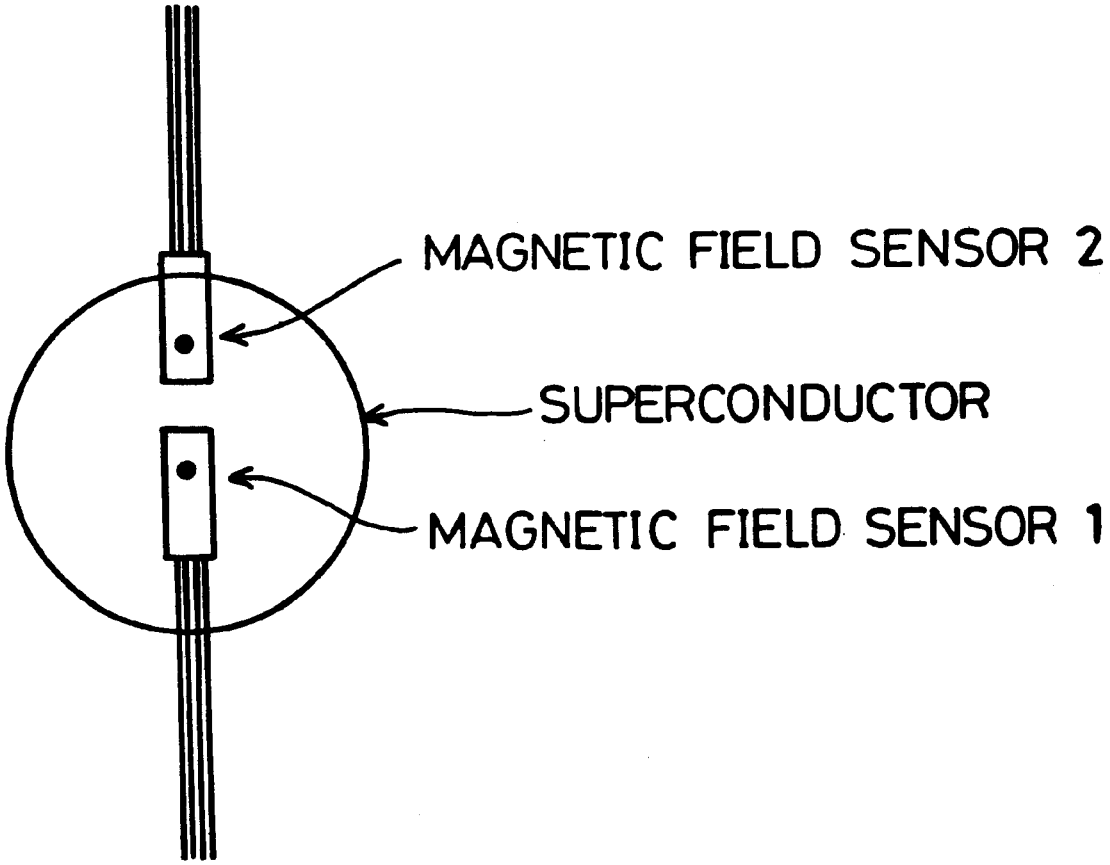
FIG. 10 illustrates am arrangement of magnetic field sensors for measuring the magnetic field captured by the superconductor according to the first embodiment.

FIG. 9 indicates the results of measurement of the magnitude of captured magnetic field at two points on the superconductor using magnetic field sensors, with the applied magnetic field sequentially increased. The points of measurement are indicated in FIG. 10. For this measurement, the superconductor was cooled to 50 K.

As indicated in FIG. 9, as the applied magnetic field was increased, the magnetic field captured by a peripheral portion of the superconductor started to increase prior to the magnetic field captured by a central portion. However, when the applied magnetic field was increased to 3 T or higher, the magnetic field captured by the central portion of the superconductor rapidly increased and then exceeded that of the peripheral portion. When the applied magnetic field exceeded 4 T, the captured magnetic field in any portion decreased.

According to the first embodiment, the superconductor 3 captured a magnetic field of 1.5 T by application of a pulsed magnetic field of 3.8 T, thereby providing a superconducting magnet apparatus producing a maximum magnetic field of 1.5 T. Since the magnetic field capturable by the superconductor 3 at the liquid nitrogen temperature (77 K) was 0.5 T, the superconducting magnet apparatus according this embodiment employing a refrigerator achieved a performance three times as high as that of the same superconductor achievable at the liquid nitrogen temperature. Furthermore, it is possible to provide a superconducting magnet apparatus with any desired produced magnetic field within the range up to the maximum captured magnetic field of the superconductor 3 possible at its operating temperature, using the data of the applied magnetic field-dependency of the captured magnetic field of the superconductor 3.

Figure 11:
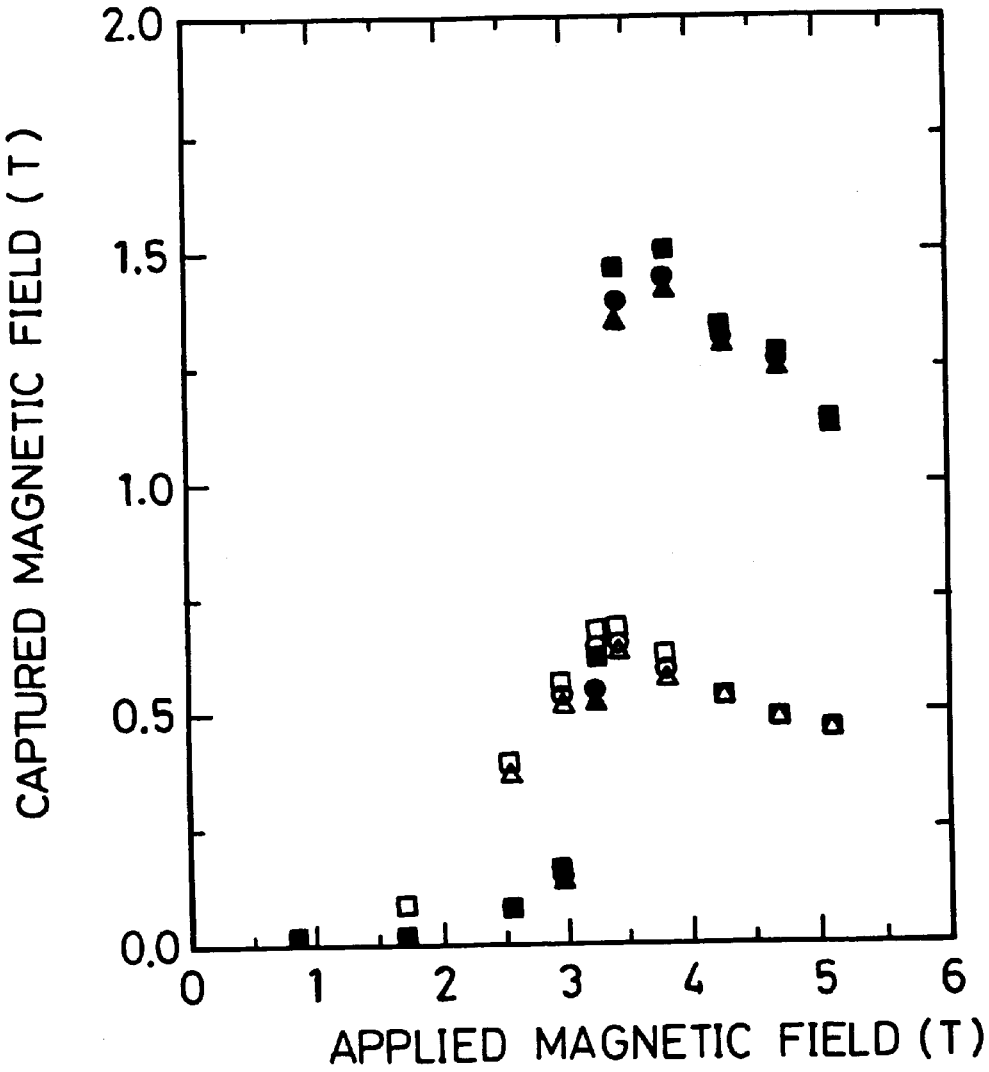
FIG. 11 is a graph indicating the changes over time of the magnetic field captured by the superconductor according to the first embodiment after the magnetization, which changes were measured in various applied magnetic fields.

The changes over time of the captured magnetic field of the superconductor after magnetization was also investigated. As indicated in FIG. 11, if the applied magnetic field was greater than 3.8 T, the attenuation of the captured magnetic field after magnetization was considerably reduced although the captured magnetic field of the superconductor decreased. This result indicates that a superconducting magnet apparatus that produces a stable magnetic field with a reduced attenuation can be provided by increasing the applied magnetic field.

In the superconducting magnet apparatus according to the first embodiment as described above, the superconductor 3 is cooled to a low temperature by the contact with the cold head 2 disposed in the insulating container 1, and turned into a magnet by causing it to directly capture a magnetic field that is instantaneously produced by supply of a pulsed current to the magnetizing coil 4 disposed near the superconductor. Since the superconductor can thus easily be magnetized so as to produce a great magnetic field, the superconducting magnet apparatus according to the first embodiment can advantageously be applied to various appliances and uses.

Since the cold head 2 is cooled by the refrigerator 20, the cold head can easily achieve temperatures lower than the temperature of liquid nitrogen, which is conveniently used as a coolant. Therefore, the superconducting magnet apparatus according to the first embodiment is able to cause a superconductor to produce a magnetic field greater than the produced magnetic field of the same superconductor that can be achieved by an apparatus using liquid nitrogen.

More specifically, since the superconductor 3 is cooled on the copper block 30 having a sufficiently large thermal capacity by the cold head 2, that is, the refrigerating portion of the refrigerator 20, it becomes possible to perform magnetization at any operating temperature within the range down to 30 K achievable by the cold head 2 provided with the heater wire. Furthermore, by controlling the output of the heater wire, the temperature can be automatically controlled, thereby facilitating utilization of low temperatures. In the aforementioned technologies employing liquid coolants, the operating temperature is limited by the temperature of the coolant (90 K for liquid oxygen, 77 K for liquid nitrogen, 27 K for liquid neon, 20 K for liquid hydrogen, 4 K for liquid helium, and the like). Among these liquid coolants, only liquid nitrogen can be practically used in applications according to the present invention. Since the apparatus according to the first embodiment is able to operate in a temperature range lower than 77 K in which the properties of a superconductor are improved, the apparatus according to the first embodiment is able to easily cause a superconductor to produce a great magnetic field compared with an apparatus employing liquid nitrogen, even if the same superconductor is used.

Furthermore, since the superconductor 3 is cooled by the cold head 2 of the refrigerator 20, the superconducting magnet apparatus according to the first embodiment does not require a coolant container, so that the distance between the superconductor 3 and the outside of the vacuum insulating container 1 can be correspondingly reduced.

Therefore, it becomes easy to effectively utilize the magnetic field captured by the superconductor in various appliances and applications.

Further, since the magnetizing coil 4 to be supplied with a pulsed current from the pulse power source 5 is disposed outside the vacuum insulating container 1 and therefore thermally separated from the superconductor 3, the superconductor 3 is free from the effects of heat generation by the magnetizing coil 4 during magnetization, thereby improving the performance of the superconducting magnet apparatus.

Furthermore, since the superconductor 3 is a bulk body formed from a RE—Ba—Cu—O— system material (where RE indicates yttrium or other rare earth elements or a combination of any of these elements), the capturable magnetic field is great so that a great magnetic field can be produced according to the first embodiment.

Further, in the method for magnetizing a superconducting magnet according to the first embodiment, the magnetizing coil 4 is energized by a pulsed current whose peak value is determined so as to produce an applied magnetic field such that the minimum value of the magnetic field penetrating into the superconductor 3 equals or exceeds the maximum value of the magnetic field captured in the superconductor. Therefore, the superconductor can capture a magnetic field close to the maximum capturable magnetic field that is determined by the properties of the superconductor, and the change from the captured magnetic field occurring immediately after magnetization can be reduced, thereby enabling production of a stable magnetic field. Therefore, the performance of the superconducting magnet apparatus can be improved.

Further, since the magnetizing coil 4 is energized by a pulsed current whose peak value is determined so as to produce am applied magnetic field such that the minimum value of the magnetic field penetrating into the superconductor 3 equals the maximum value of the magnetic field captured in the superconductor, a necessary and sufficient amount of magnetic field penetrates into the superconductor 3, eliminating the possibility of increased heat generation by an excessive amount of magnetic field. Therefore, the method according to the first embodiment is able to capture a maximum magnetic field that is capturable based on the properties of the superconductor 3, thereby improving the magnet performance of the superconducting magnet apparatus. Moreover, since the magnetizing coil 4 is able to produce a minimal but sufficient amount of magnetic field, the size of the magnetizing coil can be made as small as possible, thereby facilitating design of a simplified superconducting magnet apparatus.

Further, since the pulsed current supplied to the magnetizing coil 4 is controlled so that the supply time is equal to or shorter than a predetermined time, the amount of heat generated by the magnetizing coil 4 during magnetization is limited to a predetermined value or lower. Therefore, it becomes possible to supply a large current to a simplified coil and easily produce a great applied magnetic field that is necessary for the superconductor 3 to capture a great magnetic field.

Second Embodiment

Figure 12:
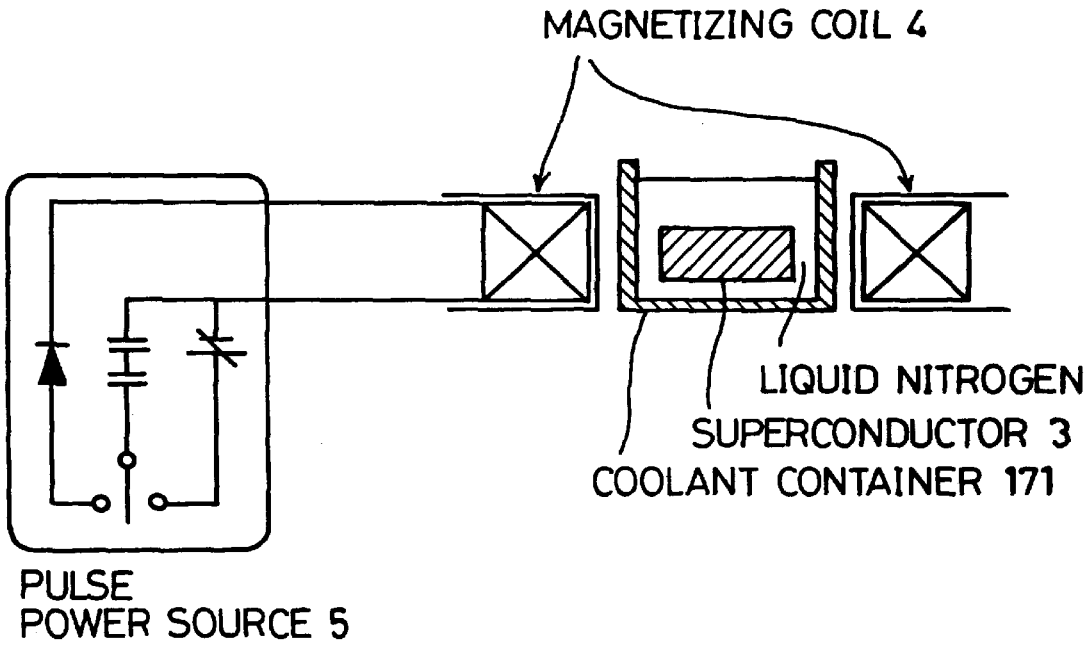
FIG. 12 is a block diagram illustrating a basic construction of a superconducting magnet apparatus and a method for magnetizing a superconducting magnet according to a second embodiment of the present invention.

A superconducting magnetic apparatus and a method for magnetizing the superconducting magnetic apparatus according to a second preferred embodiment of the invention employ a construction as shown in FIG. 12. A coolant container 171 contains a coolant that is capable of cooling a superconductor 3 to its superconduction transition temperature or lower. The superconductor 3 is disposed in the coolant container 171. A magnetizing coil 4 is provided for applying a magnetic field to the superconductor 3. A pulse power source 5 supplies the magnetizing coil 4 with a pulsed current. The magnetizing coil 4 is disposed outside the coolant container 6.

The coolant container 171 contains liquid nitrogen as a coolant. The superconductor 3, the magnetizing coil 4 and the pulse power source 5 are substantially the same as those in the first embodiment.

To determine an optimal current to be supplied from the pulse power source 5 to the magnetizing coil 4 so as to apply an optimal magnetic field so that the superconductor 3 captures a great magnetic field according to the second embodiment, substantially the same experiments as in the first embodiment were performed.

The results were that the captured magnetic field of the superconductor 3 exhibited dependency on the applied magnetic field similar to that exhibited in the experiment according to first embodiment where the temperature was 77 K, and that the maximum captured magnetic field was 0.5 T. It is confirmed that if the temperature is the same, the captured magnetic field of the superconductor 3 becomes the same regardless of the devices or methods used to cool the superconductor.

According to the second embodiment, since the magnetizing coil 4 is disposed outside the coolant container 171 and therefore is thermally separated from the superconductor 3, the superconductor 3 is free from the effects of heat generation by the magnetizing coil 4 during magnetization performed by energizing the magnetizing coil 4, thereby enabling further stable pulsed magnetization.

Furthermore, since the magnetizing coil 4 is disposed outside the coolant container 171 containing the superconductor 3, it is easy to separate the magnetizing coil, the magnetizing power source and the coolant container containing the superconductor 3 having a captured magnetic field which serves as a magnet. Thus, the magnetizing coil and the magnetizing power source, which are needed only for magnetization, can be disconnected and separated from the coolant container containing the superconductor after magnetization, and the functional portion for generating a magnetic field can be handled independently of other portions of the superconducting magnet apparatus, and can thus be used in various appliances and applications.

Third Embodiment

A third embodiment of the present invention will be described. A superconducting magnet apparatus according to this embodiment has substantially the same construction as the apparatus according to the first embodiment shown in FIG. 1, and will not be described again.

A method for magnetizing a superconductor according to the third embodiment performs pulsed magnetization of the superconductor a plurality of times. In an example of this embodiment, the superconductor 3 was subjected three times to application of a maximum pulsed magnetic field E 1 of 7.1 T, which was greater than the maximum capturable magnetic field of the superconductor 3. Subsequently, a slightly reduced pulsed magnetic field was applied a plurality of times. This procedure was repeated using gradually reduced pulsed magnetic fields. Finally, a pulsed magnetic field E 2 of 2.8 T was applied, thereby magnetizing the superconductor 3. The captured magnetic field of the superconductor 3 was measured on a central surface portion. The magnitude (2.8 T) of the last applied pulsed magnetic field was greater than the magnitude of the pulsed magnetic field applied immediately before the last.

Figure 13:
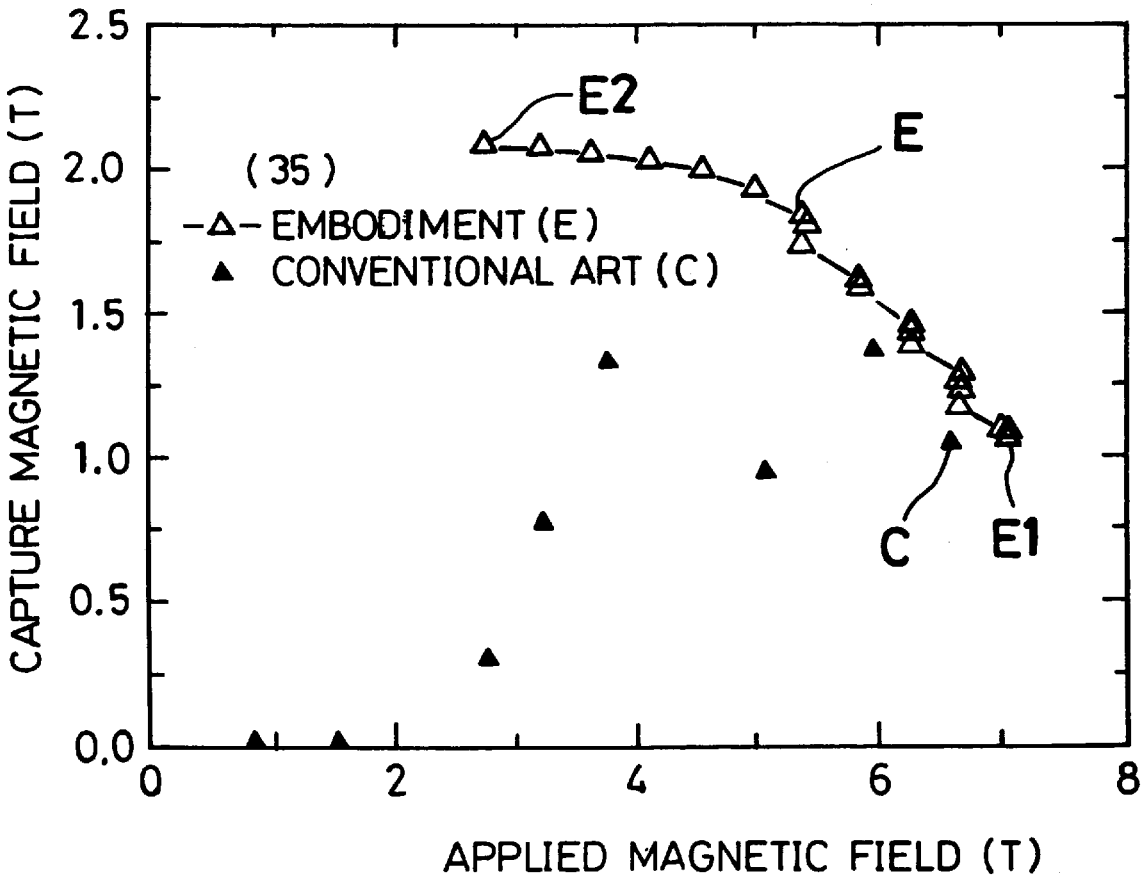
FIG. 13 is a graph indicating the effect of a method for magnetizing a superconductor according to a third embodiment of the invention.

FIG. 13 is a graph indicating the results of the aforementioned measurement, wherein the abscissa axis indicates the magnitude of the pulsed magnetic field applied to the superconductor 3, and the ordinate axis indicates the magnitude of the captured magnetic field captured by the superconductor 3 through the application of the pulsed magnetic field. In the graph, the history of application of magnetic fields is indicated by symbols Δ (E), starting at E 1 and ending at E 2, and symbols (solid) Δ (C) indicate data obtained by applying a pulsed magnetic field only once to the same superconductors as used for the aforementioned measurement, for a comparison purpose.

As can be seen from the graph, the magnetic field captured by a central portion of the superconductor 3 through magnetization by the magnetizing method according to this embodiment was 1.04 T immediately after application of the maximum pulsed magnetic field of 7.1 T, and increased with the application of sequentially reduced pulsed magnetic fields, and finally reached 2.08 T after application of the pulsed magnetic field of 2.8 T, exhibiting a two-fold increase from the first magnetic field application.

On the other hand, in the measurement in which a pulsed magnetic field was applied to a non-magnetized superconductor only once in a superconducting magnet apparatus employing the same superconductor as in the aforementioned measurement, the captured magnetic field in a central portion of the superconductor reached a maximum of 1.36 T when the applied magnetic field was 6 T. The maximum captured magnetic field of 1.36 T is about two thirds of the captured magnetic field achieved by the magnetizing method according to the embodiment.

As understood from the above description, the magnetizing method according to the third embodiment makes it possible to sufficiently magnetize a superconductor using a simple apparatus even in a case where a superconductor having good properties at a low temperature is used as a superconducting magnet apparatus.

Fourth Embodiment

A superconducting magnet apparatus and a method for magnetizing a super conductor according a fourth embodiment will be described with reference to FIGS. 14–17.

Figure 14:
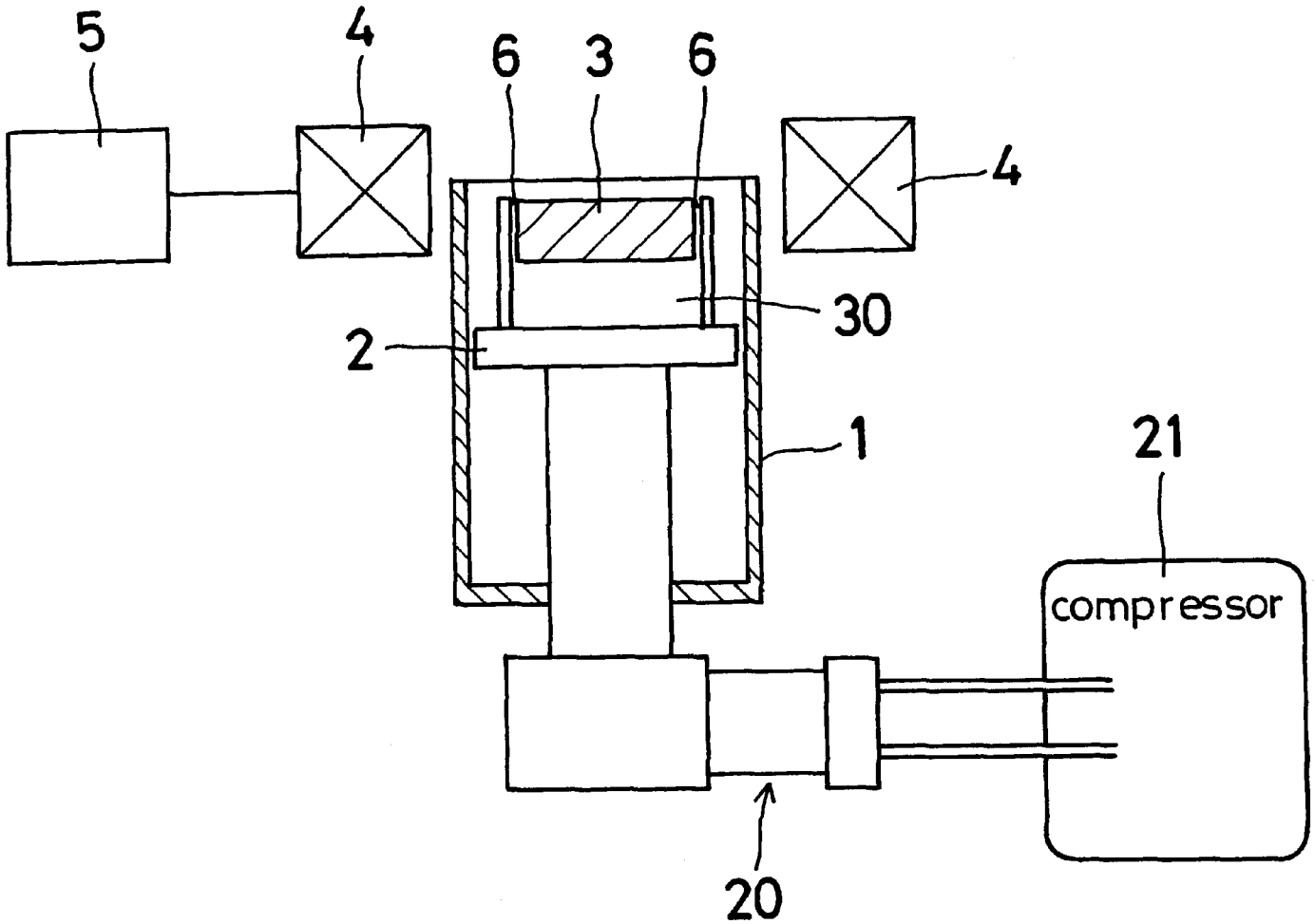
FIG. 14 illustrates the construction of a superconducting magnet apparatus according to a fourth embodiment of the invention.

Referring to FIG. 14, a superconducting magnet apparatus according to this embodiment has at superconductor 3 disposed inside an insulating container 1, a refrigerator 20 for cooling the superconductor 3, a magnetizing coil 4 for applying a pulsed magnetic field to the superconductor 3, and a heater 6 for heating the superconductor 3.

The superconductor 3 is formed into a disc shape of a radius a, from a RE—Ba—Cu—O—system material (where RE indicates yttrium or other rare earth elements or a combination of any of these elements). The heater 6 is provided around the outer periphery of the superconductor 3 as shown in FIG. 14. The heater 6 may be formed of a manganin wire.

The insulating container 1, formed of FRP (fiber reinforced plastic), contains the superconductor 3 and a cold head 2 of the refrigerator 20 as shown in FIG. 14. The insulating container 1 is vacuum-evacuated in order to prevent external heat from entering as much as possible.

The magnetizing coil 4 is disposed outside the insulating container 1 and around the superconductor 3, as shown in FIG. 14. The magnetizing coil 4 is electrically connected to a pulse power source 5 that employs capacitor discharge.

A cooling device according to this embodiment has a compressor 21 in addition to the refrigerator 20 having the cold head 2. The cold head 2 is a part for cooling by removing heat. The cold head 2 is connected to the superconductor 3 by a copper member 30, which is excellent in heat conductivity.

The procedure of magnetizing the superconductor 3 using the superconducting magnet apparatus according to the fourth embodiment will be described.

To magnetize the superconductor 3, the refrigerator 20 is first operated to cool the entire body of the superconductor 3 to a temperature $T_0$ equal to or lower than the superconduction transition temperature $T_c$ of the superconductor 3. The heater 6 is then operated to heat a peripheral portion of the superconductor 3 to a temperature $T_3$ higher than the superconduction transition temperature $T_c$.

Figures 15A, 15B:
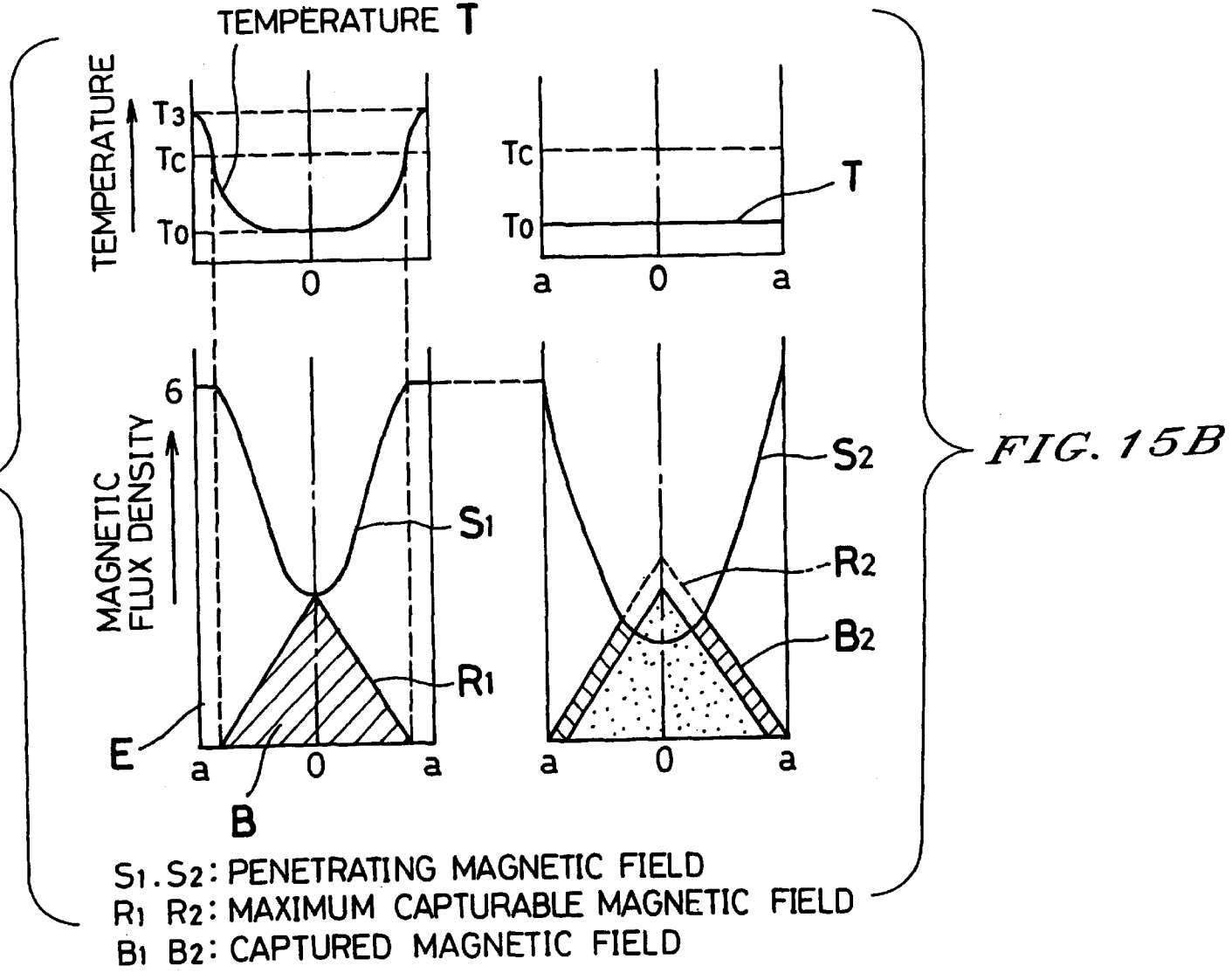
FIG. 15(*a*) is a diagram indicating the distributions of the temperature, the penetrating magnetic field, the maximum capturable magnetic field, the captured magnetic field of the superconductor according to the fourth embodiment, at the time of the first application of a pulsed magnetic field.

The upper section of the diagram of FIG. 15(*a*) indicates the distribution of the temperature T inside the superconductor 3, wherein the abscissa axis indicates the radial location in the superconductor 3, and the ordinate axis indicates the temperature. As indicated by the upper section of the diagram, the temperature of a central portion of the superconductor 3 according to this embodiment substantially remains at $T_0$ for some time after the temperature of a peripheral portion increases to $T_3$, since the superconductor 3 has a low heat conductivity.

When the superconductor 3 is in this temperature condition, a pulsed magnetic field having a magnitude of 6 T is applied to the superconductor 3. The distribution of the magnetic field $S_1$ penetrating into the superconductor 3 is indicated in the lower section of the diagram of FIG. 15(*a*), wherein the abscissa axis indicates the radial location in the superconductor 3, and the ordinate axis indicates the magnetic flux density. As can be seen from the distribution of the penetrating magnetic field $S_1$ that penetrates into the superconductor 3 indicated in the lower section of the diagram of FIG. 15(*a*), the magnetic field in a peripheral portion E where the temperature is equal to or higher than the superconduction transition temperature $T_c$ has a magnitude of 6 T, which is equal to the magnitude of the applied magnetic field.

In an inner portion where the temperature is equal to or lower than superconduction transition temperature $T_c$, the penetrating magnetic field gradually decreases with progress inward from the peripheral portion. The distribution of the magnetic field $S_1$ is greater than the distribution of the penetrating magnetic field $S_2$ (shown in the lower section in FIG. 15(*b*)) that penetrates into the superconductor 3 through application of the same magnitude of pulsed magnetic field when the temperature of the entire body of the superconductor 3 is $T_o$.

The lower section of FIG. 15(*a*) also indicates the distribution of the maximum capturable magnetic field $R_1$ of the superconductor 3 in this temperature condition. As indicated, the maximum capturable magnetic field $R_1$ is distributed as if the outside diameter of the superconductor 3 were reduced, since the peripheral portion E lacks a sufficient force to retain a magnetic field. Since the distribution of the maximum capturable magnetic field $R_1$ is contained in the distribution of the penetrating magnetic field $S_1$, the magnitude of the captured magnetic field $B_1$ becomes equal to the magnitude of the maximum capturable magnetic field $R_1$.

Subsequently, the heating of the superconductor 3 by the heater 6 is discontinued, and the entire body of the superconductor 3 is cooled again to the temperature $T_0$ by the refrigerator 20 as indicated in the upper section of FIG. 15(*b*).

In this temperature condition, the superconductor 3 is again subjected to application of a pulsed magnetic field by the magnetizing coil 4. The distribution of the penetrating magnetic field $S_2$ that penetrates into the superconductor 3 is indicated in the lower section of FIG. 15(*b*). As indicated, the distribution of the penetrating magnetic field $S_2$ becomes a parabola shape decreasing with progress from the periphery to the center of the superconductor 3. The overall size of the distribution of the penetrating magnetic field $S_2$ is smaller than that of the distribution of the previous penetrating magnetic field $S_1$. (caused by the first application of pulsed magnetic field, indicated in FIG. 15(*a*)).

The lower section of FIG. 15(*b*) also indicates the distribution of the maximum capturable magnetic field $R_2$ of the superconductor 3 in this temperature condition. As indicated, the present maximum capturable magnetic field $R_2$ is greater in size than the previous maximum capturable magnetic field $R_1$. Furthermore, a central portion of the distribution of the maximum capturable magnetic field $R_2$ exceeds the distribution of the penetrating magnetic field $S_2$. Therefore, the magnetic field $B_2$ captured from the present penetrating magnetic field $S_2$ is increased only in a peripheral portion, and a central portion thereof remains the same as in the previous distribution.

Figure 16A:
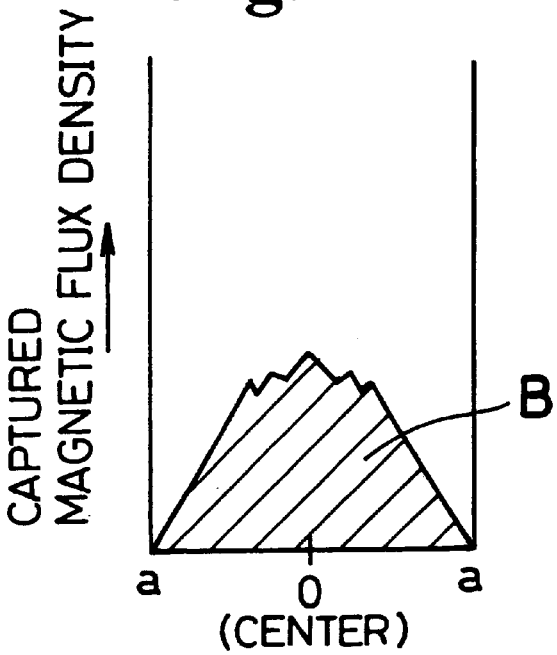
FIG. 16(*a*) is a diagram indicating the distribution of the final magnetic field captured according to the fourth embodiment.
Figure 16B:
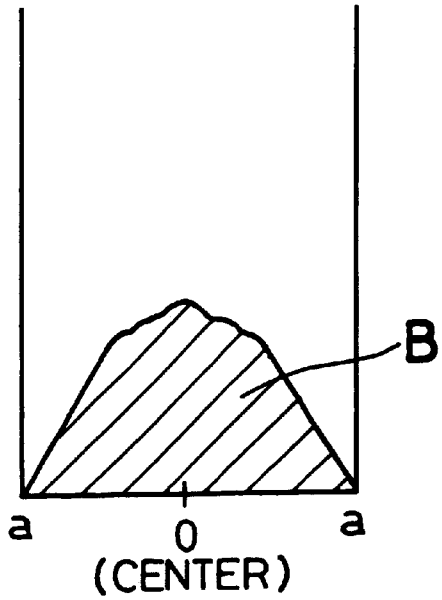

The distribution of the magnetic field B finally captured through the magnetizing procedure is indicated in FIG. 16(*a*).

Figure 17:
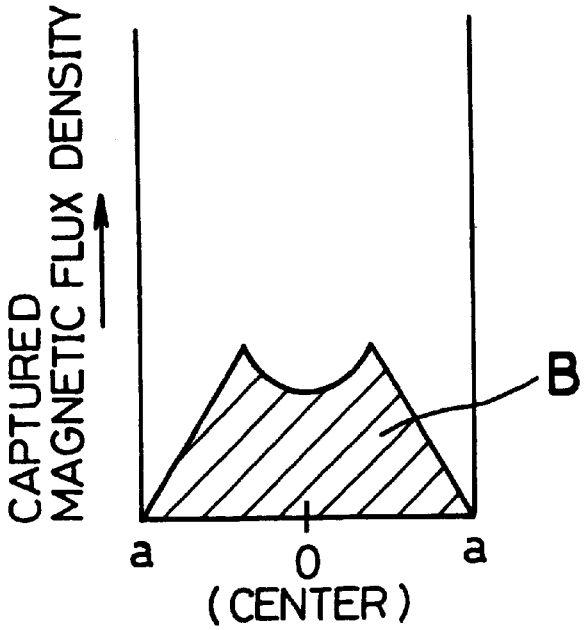
FIG. 17 is a diagram indicating the density of the captured magnetic field of a comparative example for the fourth embodiment.

FIG. 17 indicates the distribution of captured magnetic field B achieved by applying a pulsed magnetic field once to the superconductor 3 while the temperature of the entire superconductor 3 was maintained at $T_0$. As can be seen from the comparison between the diagrams of FIGS. 17 and 16(*a*), the superconductor magnetized according to the fourth embodiment has a considerably increased captured magnetic field density in a central portion, thus forming a stronger magnet.

The magnetic field B captured according to this embodiment becomes slightly leveled over time as indicated in FIG. 16(*b*).

Fifth Embodiment

Figures 18A, 18B:
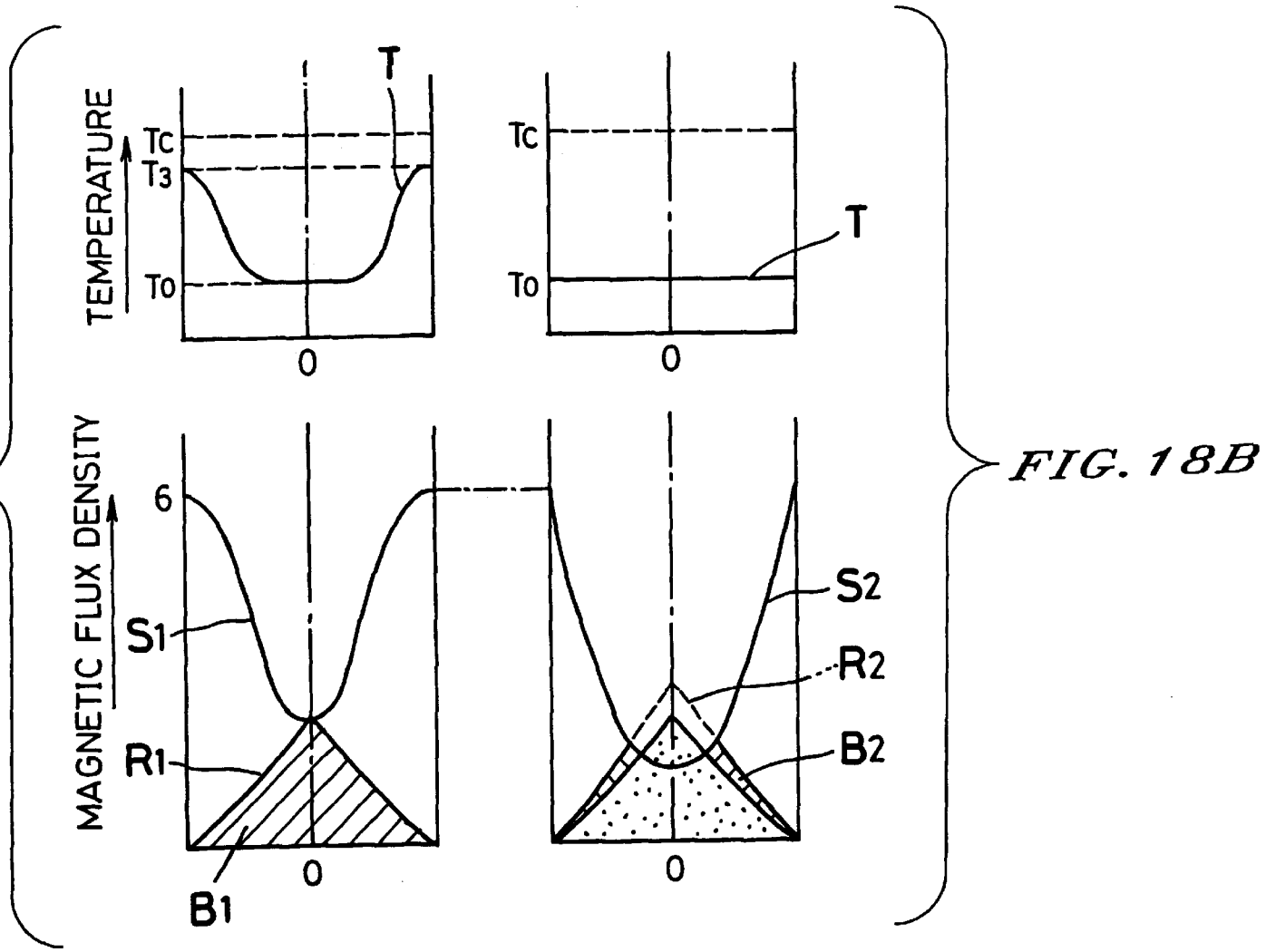
FIG. 18(*a*) is a diagram indicating the distributions of the temperature, the penetrating magnetic field, the maximum capturable magnetic field, the captured magnetic field of the superconductor according to a fifth embodiment, at the time of the first application of a pulsed magnetic field.

Distinguished from the fourth embodiment, the fifth embodiment heats a peripheral portion of a superconductor to a temperature $T_3$ that is equal to or lower than the superconduction transition temperature $T_c$ as indicated in FIG. 18, for the first application of a pulsed magnetic field. The superconducting magnet apparatus, the magnetizing procedure, and the like are substantially the same as in the fourth embodiment.

The lower section of FIG. 18(*a*) indicates the penetrating magnetic field $S_1$, the maximum capturable magnetic field $R_1$, the captured magnetic field $B_1$ corresponding to the temperature distribution T in the superconductor 3 caused by the first application of a magnetic field according to this embodiment. As indicated, the penetrating magnetic field $S_1$ according to this embodiment is slightly reduced in a peripheral portion compared with that in the fourth embodiment, so that the overall size of the penetrating magnetic field $S_1$ is also reduced. However, the penetrating magnetic field $S_1$ according to the fifth embodiment is still greater in size than the penetrating magnetic field $S_2$ caused when the temperature of the entire superconductor 3 is $T_0$ (FIG. 18(*b*)).

Therefore, the first application of a magnetic field achieves a captured magnetic field $B_1$ that is particularly strong in a central portion as indicated in FIG. 18(*a*). The second application of a magnetic field increases the acquired magnetic field $B_2$ in a peripheral portion as indicated in FIG. 18(*b*), as in the fourth embodiment.

The fifth embodiment makes it possible for the superconductor 3 to capture a great magnetic field as a whole. The embodiment also achieves substantially the same advantages as achieved by the fourth embodiment.

Sixth Embodiment

Figure 19:
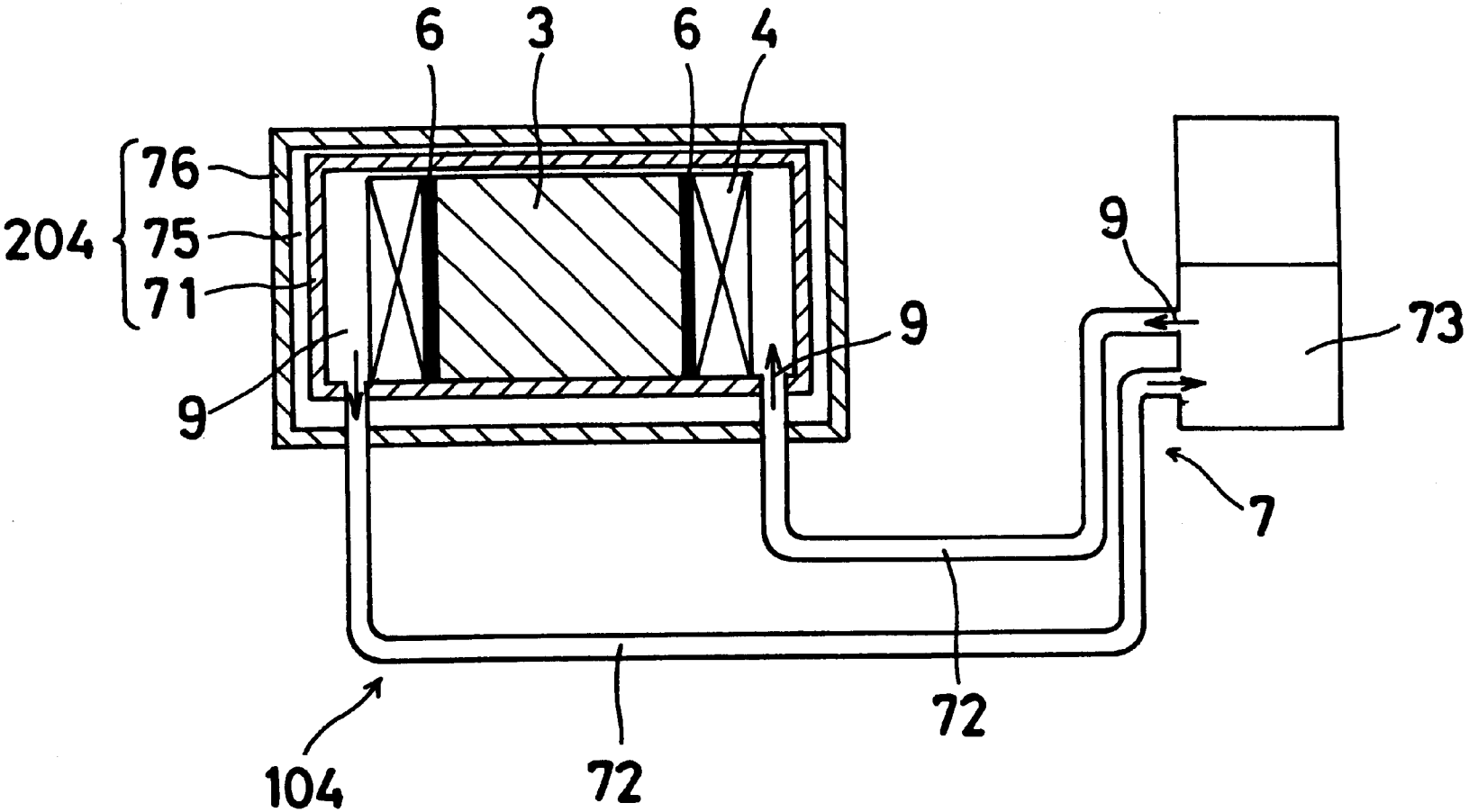
FIG. 19 illustrates the construction of a superconducting magnet apparatus according to a sixth embodiment of the invention.

Referring to FIG. 19, a superconducting magnet apparatus 104 according to a sixth embodiment employs a coolant circulating cooling device 7 for cooling the superconductor 3. The coolant circulating cooling device 7 has a coolant container 71 that contains a coolant 9, a magnetizing coil 4 and the superconductor 3 surrounded by a heater 6. The cooling device 7 further has a coolant cooling device 73 connected to the coolant container 71 by a coolant conveying duct 72. Other portions are substantially the same as in the third embodiment.

The cooling device 7 is constructed so that the coolant 9 cooled by the coolant cooling device 73 is circulated between the coolant cooling device 73 and the interior of the coolant container 71. The coolant container 71 is disposed inside a vacuum container 76 and is substantially spaced from the wall of the vacuum container 76 by a vacuum layer 75 that is pressure-reduced to a vacuum state. The vacuum container 76, the vacuum layer 75 and the coolant container 71 form an insulating container 204.

The coolant according to this embodiment is liquid nitrogen. Therefore, the temperature of the superconductor 3 can be precisely controlled at a temperature equal to or lower than 77 K, that is, the boiling paint of liquid nitrogen. This embodiment also achieves substantially the same advantages as achieved by the fourth embodiment.

Seventh Embodiment

Figure 20:
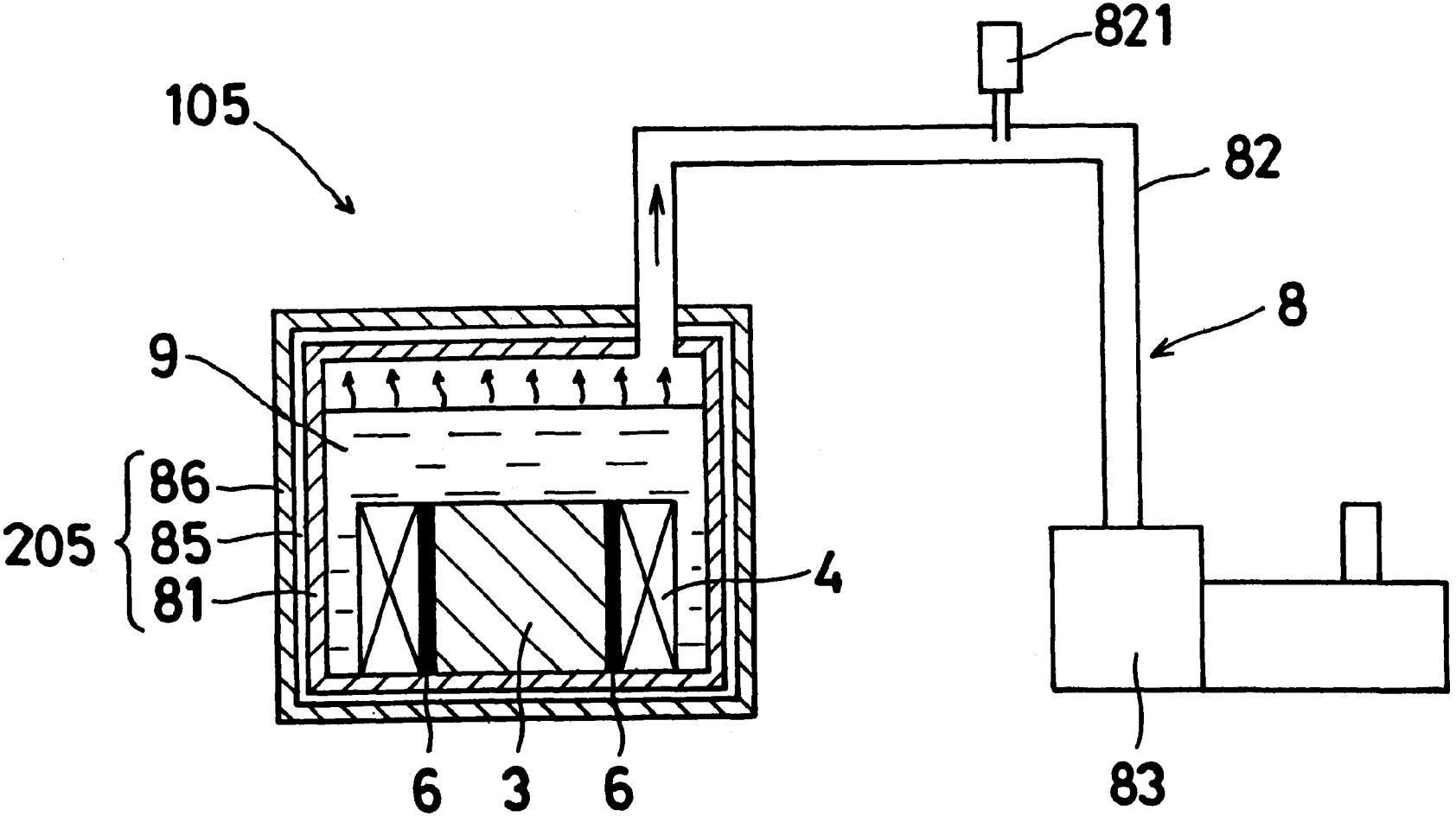
FIG. 20 illustrates the construction of a superconducting magnet apparatus according to a seventh embodiment of the invention.

Referring to FIG. 20, a superconducting magnet apparatus 105 according to a seventh embodiment employs a coolant holding cooling device 8 for cooling a superconductor 3. The coolant holding cooling device 8 has a coolant container that contains a coolant 9, a magnetizing coil 4 and the superconductor 3 surrounded by a heater 6. The cooling device 8 further has an evacuator 83 for adjusting the pressure of the vapor of the coolant 9 inside the coolant container. Other portions are substantially the same as in the third embodiment.

The coolant container 81 and the evacuator 83 are interconnected by an exhaust duct 82 that is provided with a pressure gage 821.

The coolant container 81 is disposed inside a vacuum container 86 and substantially spaced from the wall of the vacuum container 86 by a vacuum layer 85 that is pressure-reduced to a vacuum state. The vacuum container 86, the vacuum layer 85 and the coolant container 81 form an insulating container 205.

By discharging vapor from the coolant container using the evacuator 83, evaporation of the coolant 9 is promoted. Due to the heat of vaporization, the temperature of the coolant 9 decreases. Therefore, this embodiment is able to easily perform the temperature control of the coolant 9, that is, the temperature control of the superconductor 3. The seventh embodiment also achieves substantially the same advantages as achieved by the fourth embodiment.

Eighth Embodiment

An eighth embodiment of the invention will be described. A superconducting magnet apparatus according to this embodiment has substantially the same construction as the apparatus according to the first embodiment shown in FIG. 1, and will not be described again.

Figures 21A, 21B, 21C:
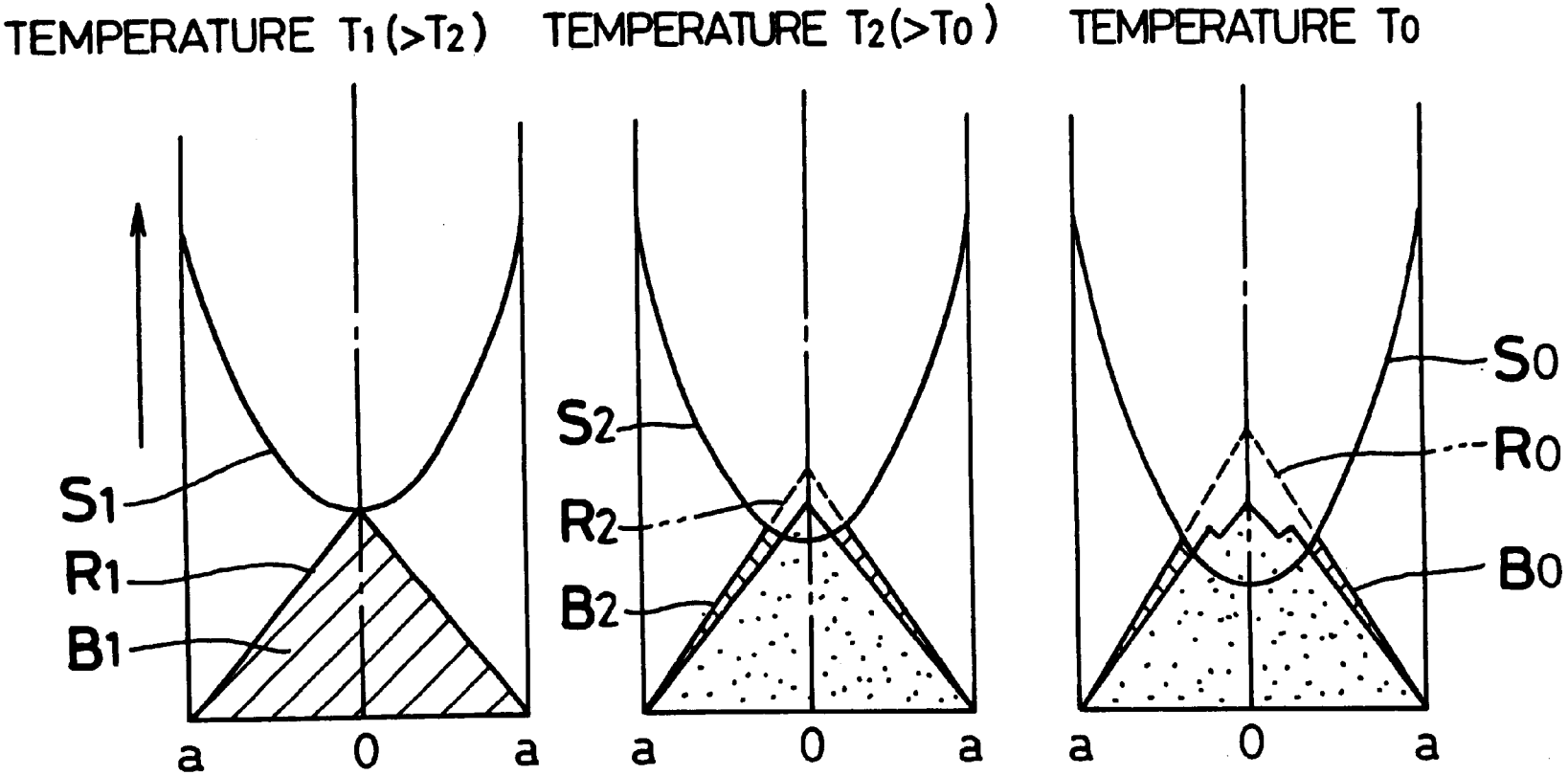
FIGS. 21(*a*), 21(*b*) and 21(*c*) are diagrams indicating the distribution of the penetrating magnetic field and the distribution of the captured magnetic field at a temperature of T1, a temperature of T2 and a temperature of T0, respectively, according to an eighth embodiment of the invention.

A method for magnetizing a superconductor according to the eighth embodiment is a pulsed magnetization method that repeats application of a pulsed magnetic field a plurality of times while the temperature of superconductor is being reduced, as indicated in FIGS. 21(*a*)–21(*c*) and 22.

Proceeding to description of the superconductor magnetizing method according to this embodiment, the relationship between the temperature of a superconductor and the penetrating magnetic field or the acquired magnetic field of the superconductor will be described.

Figure 25:
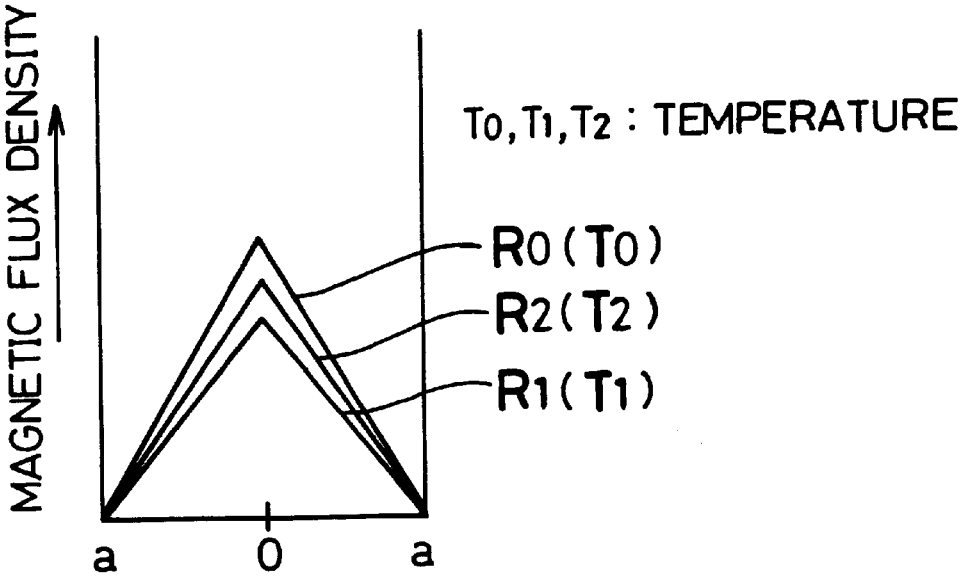
FIG. 25 is a diagram indicating the relationship between the temperature of a superconductor and the distribution of the maximum capturable magnetic field according to the eighth embodiment.
Figure 26:
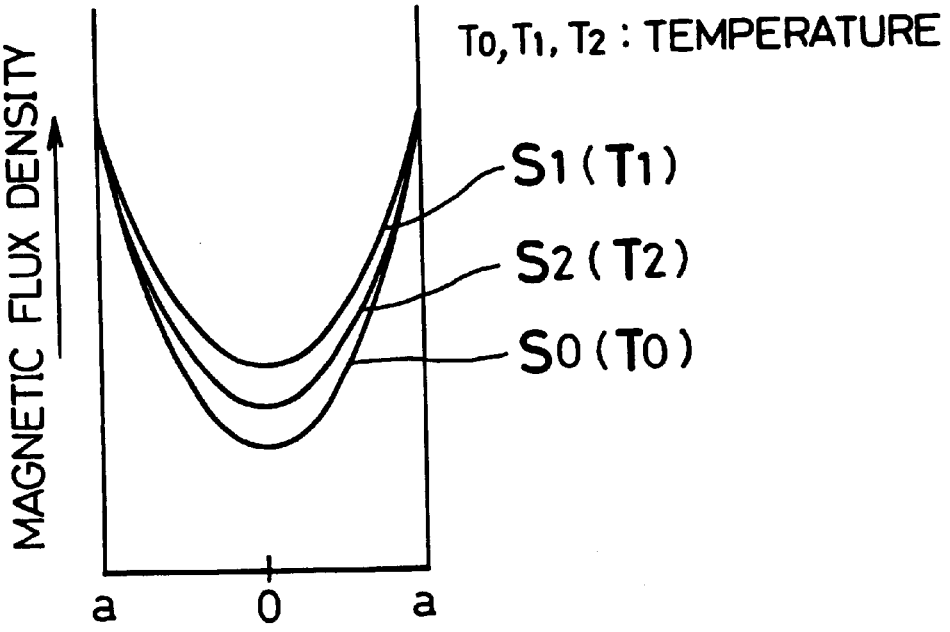
FIG. 26 is a diagram indicating the relationship between the temperature of a superconductor and the distribution of the penetrating magnetic field according to the eighth embodiment.

FIG. 25 indicates the relationship between the temperature and the acquired magnetic field of a superconductor. FIG. 26 indicates the relationship between the temperature and the penetrating magnetic field of a superconductor. In the graphs of FIGS. 25 and 26, temperatures $T_0$, $T_2$, $T_1$ satisfy the relationship of $T_0<T_2<T_1$. As indicated in FIG. 25, the magnetic field acquired by the superconductor increases as the temperature of the superconductor decreases. As indicated in FIG. 26, the magnetic field penetrating into the superconductor decreases as the temperature of the superconductor decreases. This relationship is established because the critical current density Jc of the superconductor is dependent on temperature.

Figure 22:
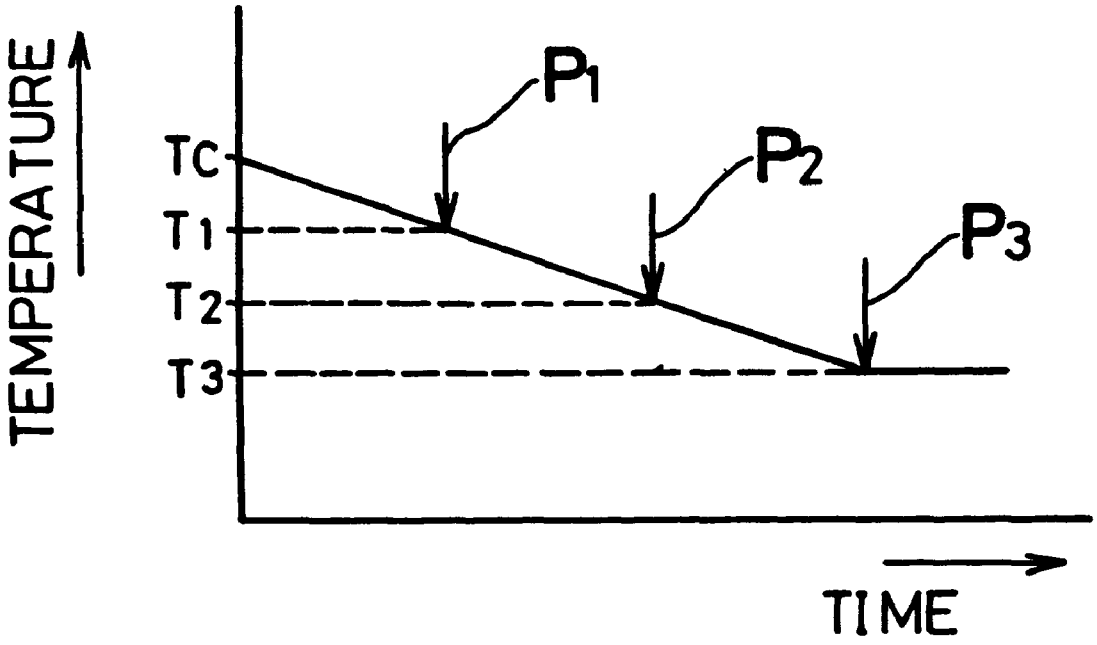
FIG. 22 is a diagram indicating the temperature of a superconductor and the timing of applying a pulsed magnetic field according to the eighth embodiment.

An example of the magnetizing procedure according to this embodiment is indicated in FIG. 22, where the abscissa axis indicates time and the ordinate axis indicates the temperature of a superconductor, and where the timing of applying a pulsed magnetic field is indicated by arrows $P_1$, $P_2$ and $P_3$.

In this example, during reduction of the temperature of the superconductor from its superconduction transition temperature $T_c$ to a temperature $T_0$, pulsed magnetic fields $P_1$, $P_2$ were applied at intermediate temperatures $T_1$ and $T_2$, and another pulsed magnetic field $P_3$ was applied to the superconductor at the final temperature $T_0$. In short, a pulsed magnetic field was applied to the superconductor three times while the temperature of the superconductor was being reduced.

By the first application of the pulsed magnetic field $P_1$ to the superconductor at the temperature $T_1$, a penetrating magnetic field $S_1$ was achieved as indicated in FIG. 21(*a*). The penetrating magnetic field $S_1$ exceeded the maximum capturable magnetic field $R_1$ of the superconductor at the temperature $T_1$ throughout the entire body of the superconductor. Therefore, the first pulsed application of the pulsed magnetic field $P_1$ caused the superconductor to capture a greatest-possible magnetic field $B_1$ corresponding to the maximum capturable magnetic field $R_1$.

By the second application of the pulsed magnetic field $P_2$ to the superconductor at the temperature $T_2$, a penetrating magnetic field $S_2$ was achieved as indicated in FIG. 21(*b*). Since the temperature $T_2$ is lower than the temperature $T_1$, the penetrating magnetic field $S_2$ at the temperature $T_2$ is smaller than the penetrating magnetic field $S_1$ at the temperature $T_1$ (see FIG. 26). In contrast, the maximum capturable magnetic field $R_2$ at the temperature $T_2$ is greater than the maximum capturable magnetic field $R_1$ at the temperature $T_1$ (see FIG. 25). Therefore, a captured magnetic field $B_2$ was added in a peripheral portion of the superconductor, as indicated in FIG. 21(*b*).

By the third application of the pulsed magnetic field $P_3$ to the superconductor at the temperature $T_0$, a penetrating magnetic field $S_0$ was achieved as indicated in FIG. 21(*c*). Since the temperature $T_0$ is lower than the temperatures $T_1$, $T_2$, the penetrating magnetic field So at the temperature $T_0$ is smaller than the penetrating magnetic fields $S_1$, $S_2$ at the temperatures $T_1$, $T_2$ (see FIG. 26). In contrast, the maximum capturable magnetic field $R_0$ at the temperature $T_0$ is greater than the maximum capturable magnetic fields R1, $R_2$ at the temperature $T_1$, $T_2$ (see FIG. 25). Therefore, another captured magnetic field $B_0$ was added in a peripheral portion of the superconductor, as indicated in FIG. 21(*c*).

Figure 23A:
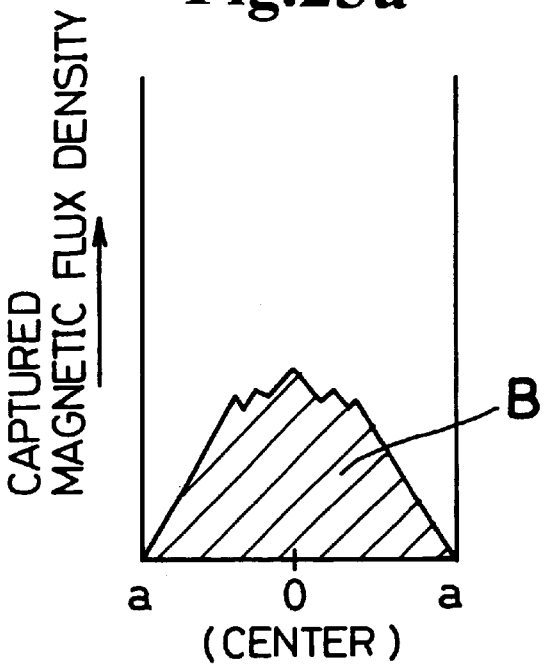
FIG. 23(*a*) is a diagram indicating the distribution of the final magnetic field captured according to the eighth embodiment.
Figure 23B:
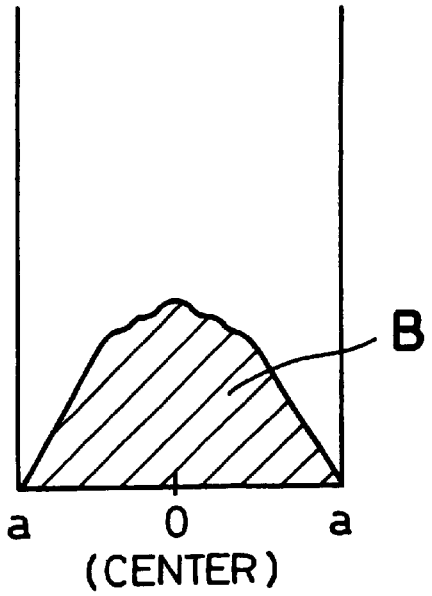

Through this magnetizing procedure, a superconducting magnet having a captured magnetic field 13 with a distribution shape as indicated in FIG. 23(*a*) was obtained. The distribution shape of the captured magnetic field B became slightly leveled over time as indicated in FIG. 23(*b*).

Figure 24:
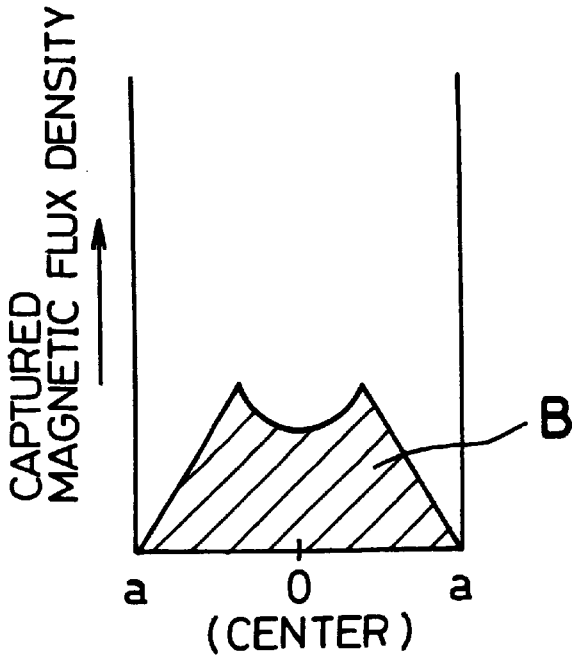
FIG. 24 is a diagram indicating the density of the captured magnetic field of a comparative example for the eighth embodiment.

For a comparison, the distribution shape of a captured magnetic field B achieved by applying a pulsed magnetic field of the same magnitude as above only once is indicated in FIG. 24. As can be seen from the comparison between the distribution shapes indicated in FIGS. 24 and 23(*a*), the method for magnetizing a superconductor according to this embodiment is able to achieve a greater magnetic flux density in a central portion of the superconductor than a method that applies a pulsed magnetic field only once.

Although the eighth embodiment uses a superconducting magnet apparatus as shown in FIG. 1, it is also possible to use a superconducting magnet apparatus as shown in FIG. 14 which has a heater for heating a superconductor. If a superconducting magnet apparatus as shown in FIG. 14 is used, it becomes possible to easily and quickly increase the temperature of the superconductor that has been cooled to the temperature $T_0$. Therefore, remagnetization of the superconductor can easily be performed, for example, in a case where the captured magnetic field of the superconductor has decreased over time.

Ninth Embodiment

A superconducting magnet apparatus employing a superconductor magnetizing method according to a ninth embodiment of the present invention will be described.

Figure 27:
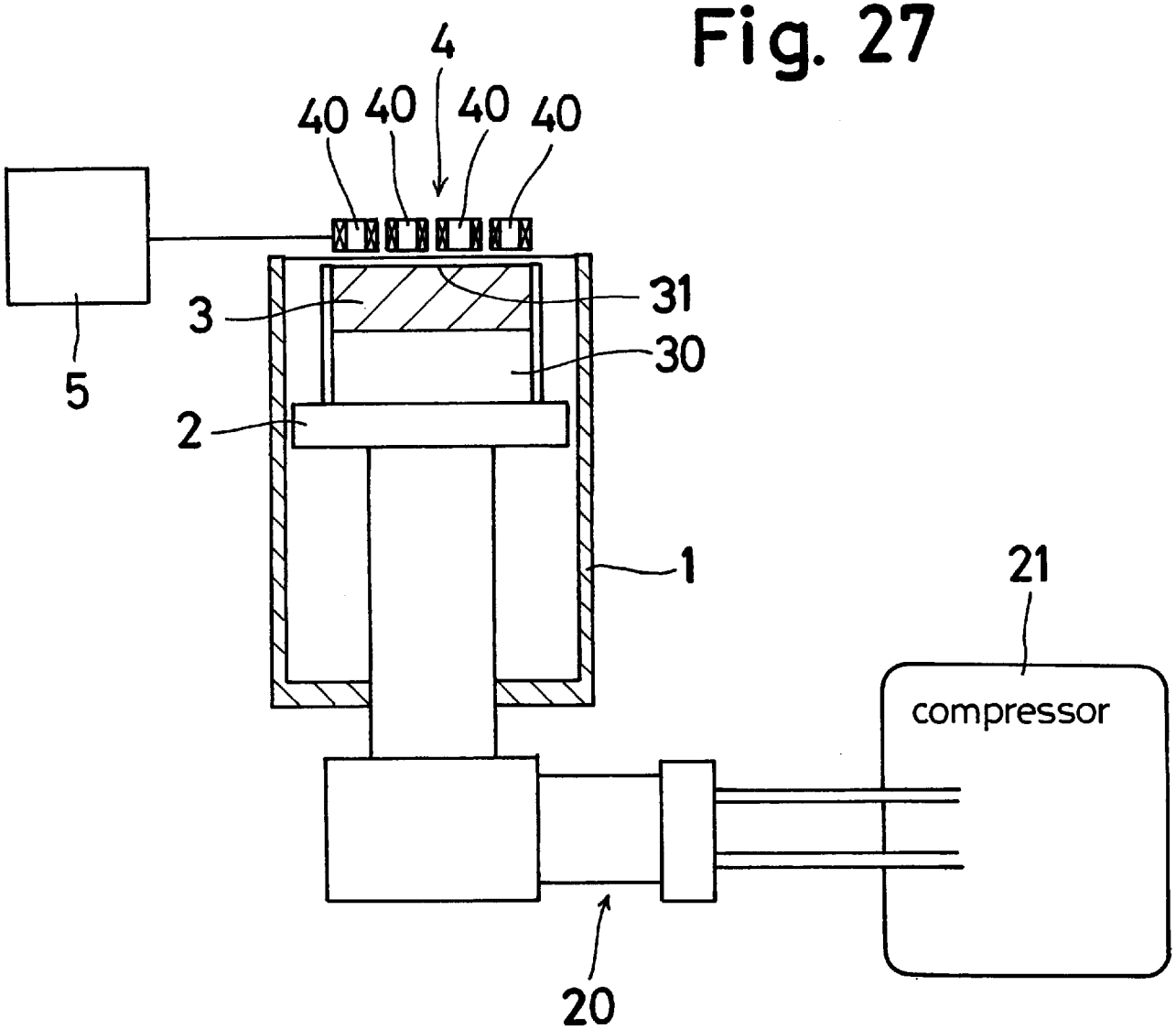
FIG. 27 illustrates the construction of a superconducting magnet apparatus according to a ninth embodiment of the invention.

Referring to FIG. 27, a superconducting magnet apparatus 1 according to this embodiment has a superconductor 3 disposed inside an insulating container 1, a refrigerator 20 provided as a cooling device for cooling the superconductor 3, and a magnetizing coil device 4 that is energized by a pulsed current to apply a pulsed magnetic field to the superconductor 3. The magnetizing coil device 4 is disposed at a side of the superconductor 3, facing the superconductor 3, as shown in FIGS. 27 and 28.

Figure 28:
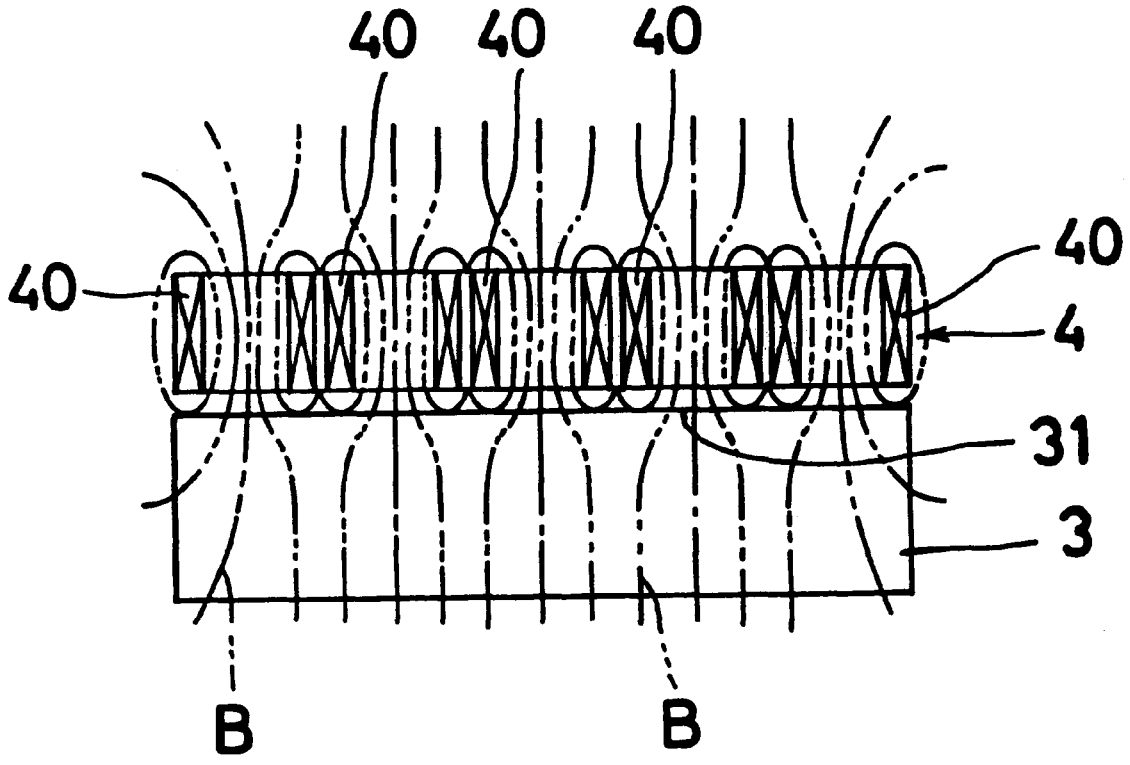
FIG. 28 illustrates the arrangement of magnetizing coils according to the ninth embodiment.

The magnetizing coil device 4 is formed of a plurality of small magnetizing coils 40 disposed side by side and facing a magnetization surface of 31 of the superconductor 3 as shown in FIGS. 27 and 28. Each magnetizing coil 40 is connected to a power source 5 for supplying a pulsed current thereto. The power source 5 utilizes capacitor discharge.

The magnetizing coil device 4 is disposed outside the insulating container 1. Therefore, the magnetizing coil device 4 is separated from the superconductor by a portion of the insulating container 1.

The superconductor 3 is a disc-shaped high-temperature superconductor formed from a RE—Ba—Cu—O— system material (where RE indicates yttrium or other rare earth elements or a combination of any of these elements).

The insulating container 1, formed of FRP (fiber reinforced plastic), contains the superconductor 3 and at cold head 2 of the refrigerator 20 (described below) as shown in FIG. 27. The insulating container 1 is vacuum-evacuated in order to prevent external heat from entering as much as possible.

The refrigerator 20 is a known cooling device that has a compressor 21 and a cold head 2. The cold head 2 is a part for cooling by removing heat. The cold head 2 is connected to the superconductor 3 by a copper member 30, which is excellent in heat conductivity.

The operation of this embodiment will next be described.

$T_0$ magnetize the superconductor 3 in the superconducting magnet apparatus according to this embodiment, the refrigerator 20 is first operated to cool the superconductor 3 disposed in the insulating container 1 to a temperature To equal to or lower than the superconduction transition temperature $T_c$ of the superconductor 3.

Subsequently, a pulsed current is supplied from the power source 5 to the magnetizing coil device 4 disposed outside the insulating container 1.

The magnetizing coil device 4 thereby produces and applies a uniform magnetic field to the superconductor 3 in the magnetizing direction, as indicated by magnetic flux lines B in FIG. 28. The superconductor 3 is thereby magnetized approximately uniformly in a macroscopic view.

Since the magnetizing coil device 41 is disposed outside the insulating container 1 according to the embodiment, the magnetizing coil device 4 can be removed from the superconducting magnet apparatus. This is advantageous when the superconducting magnet apparatus is used as a magnetic field producing apparatus after magnetization, making it possible to handle the apparatus with a reduced size.

Tenth Embodiment

Figure 29A:
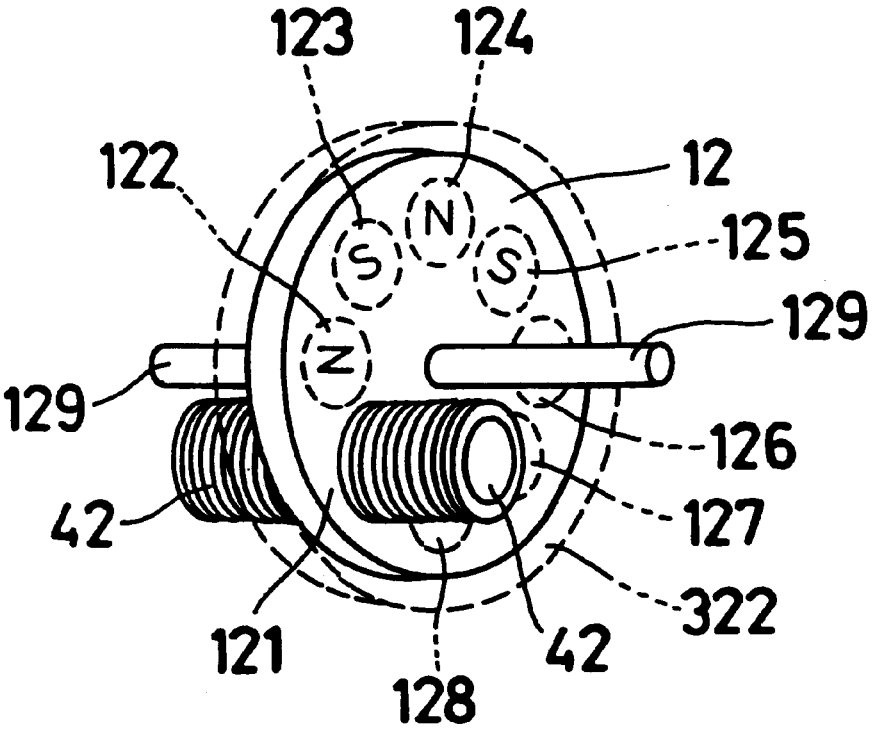
FIGS. 29(*a*) and 29(*b*) illustrate a procedure of magnetizing superconductors according to a tenth embodiment.
Figure 29B:
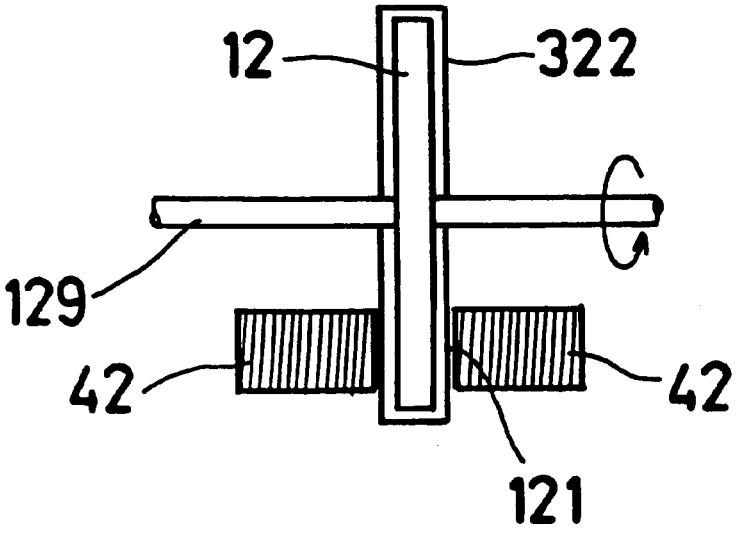

According to a tenth embodiment of the present invention, a superconductor is used in a motor or generator arrangement as shown in FIGS. 29(*a*) and 29(*b*).

A disc-shaped superconductor 12 is provided with a shaft 129 extending through a central portion of the superconductor 12. The superconductor 12 is disposed inside an insulating container 322, and cooled to its superconduction transition temperature $T_c$ or lower by a cooling device (not shown).

To magnetize the superconductor 12, a pair of magnetizing coils 42 are positioned on both sides of the insulating container 322 so as to indirectly sandwich one of magnetization portions 121–128 (a portion 121 in FIGS. 29(*a*), 29(*b*)) of the superconductor 12 disposed in the insulating container 322. The magnetizing coils 42 are then supplied with a pulsed current to produce a pulsed magnetic field. The pulsed magnetic field is produced in a direction such that the right-hand side (in FIG. 29(*b*)) of the magnetic field captured by the magnetization portion 121 will become a south (S) pole. The magnetization portion 121 thereby captures a magnetic field with the predetermined polarity.

Subsequently, the superconductor 12 is turned 45° to position an adjacent magnetization portion 122 between the magnetizing coils 42. A pulsed current is then supplied to the magnetizing coils 42 in a direction opposite to the direction of the previous pulsed current. Therefore, a pulsed magnetic field is produced in a direction opposite to the direction of the previous pulsed magnetic field, and the magnetization portion 122 is magnetized with a polarity opposite to the polarity of the neighboring magnetization portion 121. This magnetizing operation is sequentially repeated for the other magnetization portions 123–128 by turning the superconductor 12 by 45° at a time and alternating the direction of pulsed magnetic field application. Thereby, the disc-shaped superconductor 12 becomes a rotor in which the magnetized portions 121–128 are arranged with alternate polarities.

Figure 30:
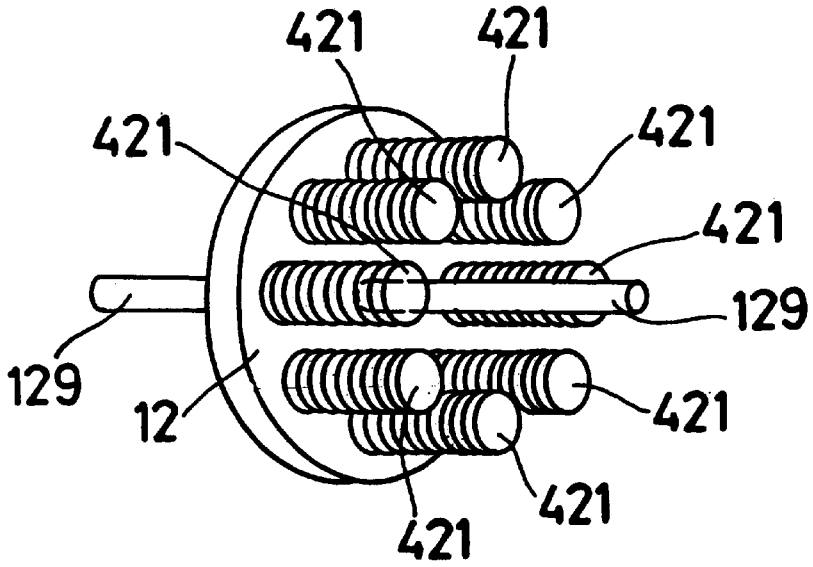
FIG. 30 illustrates an arrangement according to the tenth embodiment wherein superconductors are incorporated in a motor.
Figure 31:
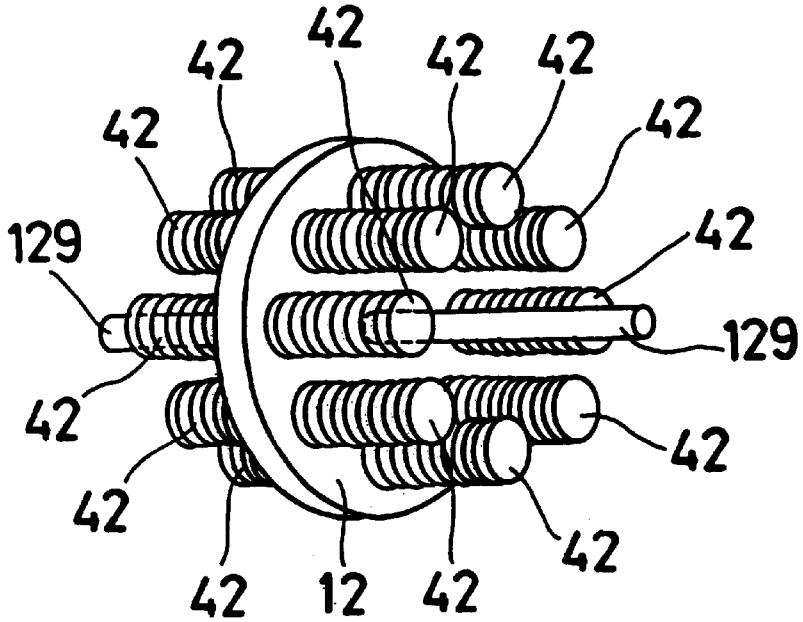
FIG. 31 illustrates another arrangement according to the tenth embodiment wherein superconductors are incorporated in a motor.

The superconductor 12, now a rotor, is disposed inside a motor case (not shown) wherein eight armatures 421 are circularly arranged as shown in FIG. 30. By supplying the individual armatures 421 with currents in alternately opposite directions, rotating magnetic fields are produced. The superconductor 12 thus functions as a motor.

For use in a power generator, the shaft 129 of the superconductor 12 is connected to a drive system provided for rotating the superconductor 12. Thereby, the individual armatures 421 produce induced currents.

In a case where the superconductor 12 is used in a motor, it is also possible to dispose eight magnetizing coils 42 on each side of the superconductor 12 beforehand. With this arrangement, the magnetizing coils 42 can also be used as stationary armatures of the motor. More specifically, for magnetization of the superconductor 12, the eight magnetization portions 121–128 are magnetized by the corresponding magnetizing coils 42 while the superconductor 12 is stopped. After magnetization, rotating magnetic fields can be produced by controlling the current supplies to the magnetizing coils 42. The magnetizing coils 42 thus serve as stationary armatures.

Eleventh Embodiment

Figure 32A:
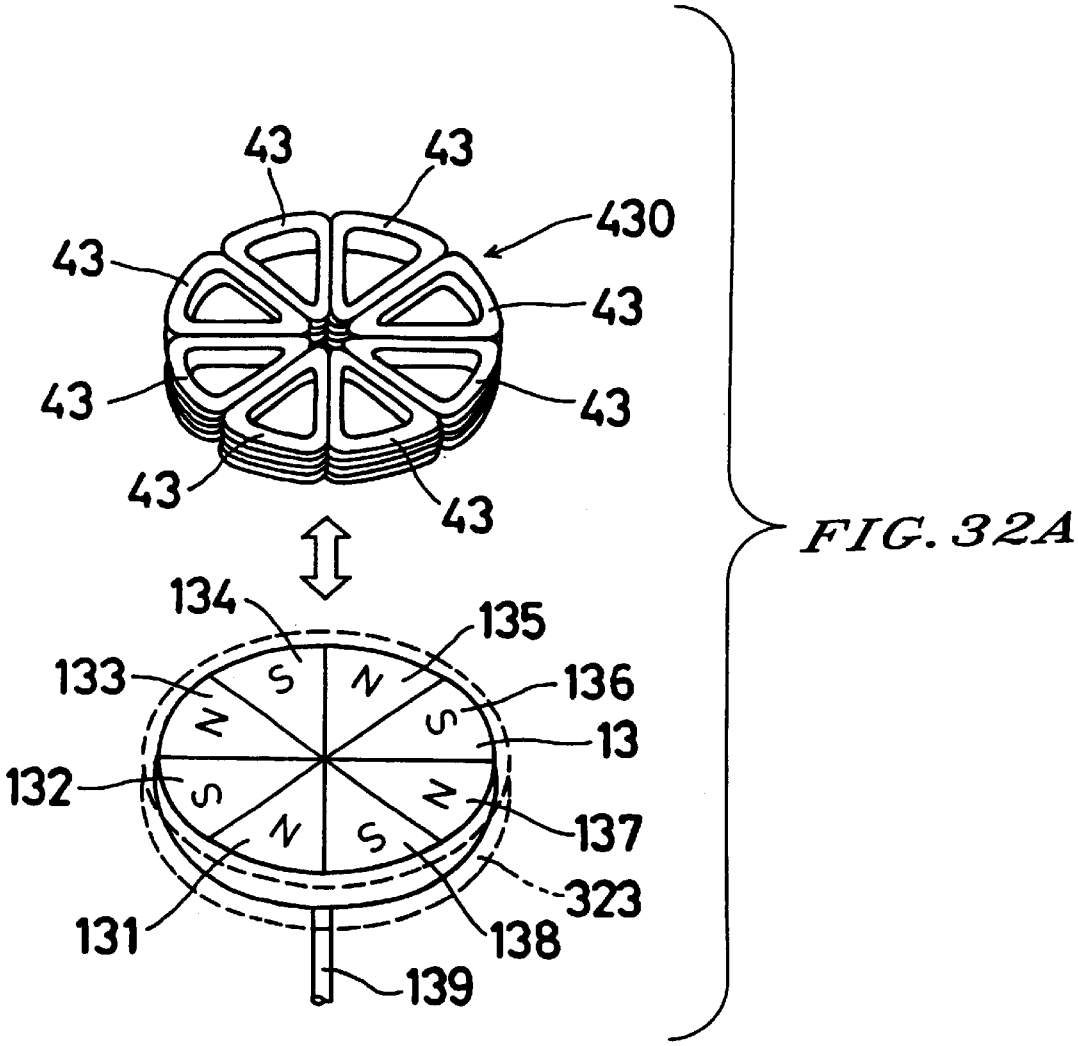
FIG. 32(*a*) illustrates a procedure of magnetizing superconductors according to an eleventh embodiment.
Figure 32B:
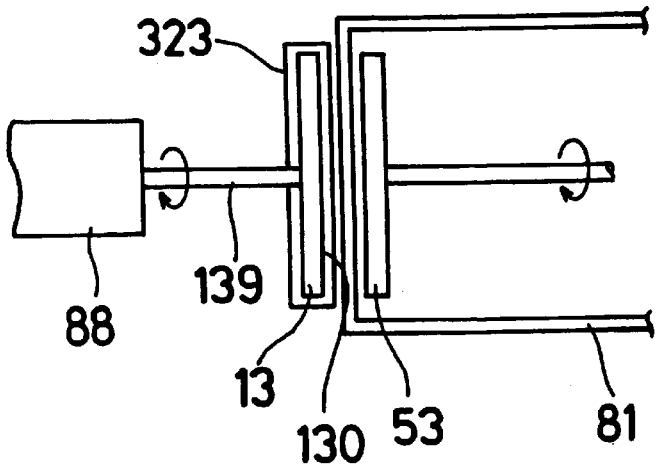

According to an eleventh embodiment of the present invention, a disc-shaped superconductor is used as a magnetic coupling for transmitting power in a non-contact manner as shown in FIGS. 32(*a*) and 32(*b*).

A disc-shaped superconductor 13 is disposed inside an insulating container 323, and cooled to its superconduction transition temperature Tc or lower by a cooling device (not shown). The superconductor 13 is provided with a shaft 139 extending from a reverse side of the superconductor 13 for transmitting power.

To magnetize the superconductor 13, a magnetizing coil unit 430 formed of an arrangement of eight sector-shaped magnetizing coils 43 as shown in FIG. 32(*a*) is used. The magnetizing coil unit 430 is positioned facing a magnetization surface of the superconductor 13. The individual coils 43 are then energized in such a manner that the individual magnetizing coils 43 produce pulsed magnetic fields in alternately opposite directions.

By this magnetization, magnetization portions 131–138 of the superconductor 13 capture magnetic fields with alternately opposite polarities as shown in FIG. 32(*a*).

To use the thus-magnetized superconductor 13 as a magnetic coupling, the shaft 139 of the superconductor 13 is connected to a motor 88, and the superconductor 13 is positioned so that the magnetization surface 130 of the superconductor 13 faces a counter coupling disc 53.

The counter coupling disc 53 may be a superconductor magnetized as described above, or a permanent magnet. However, it is necessary that the counter coupling disc 53 have magnetization portions in an alternate polarity arrangement as in the superconductor 13. As shown in FIG. 32(*b*), the superconductor 13 and the counter coupling disc 53 may be spaced from each other by a predetermined distance in a non-contact arrangement as shown in FIG. 32(*b*). Therefore, if the counter coupling disc 53 is disposed in a closed vacuum chamber 81, power can easily be transmitted from the superconductor 13 to the counter coupling disc 53.

Twelfth Embodiment

According to a twelfth embodiment of the present invention, magnetization of a long superconductor will be described.

Figure 33:
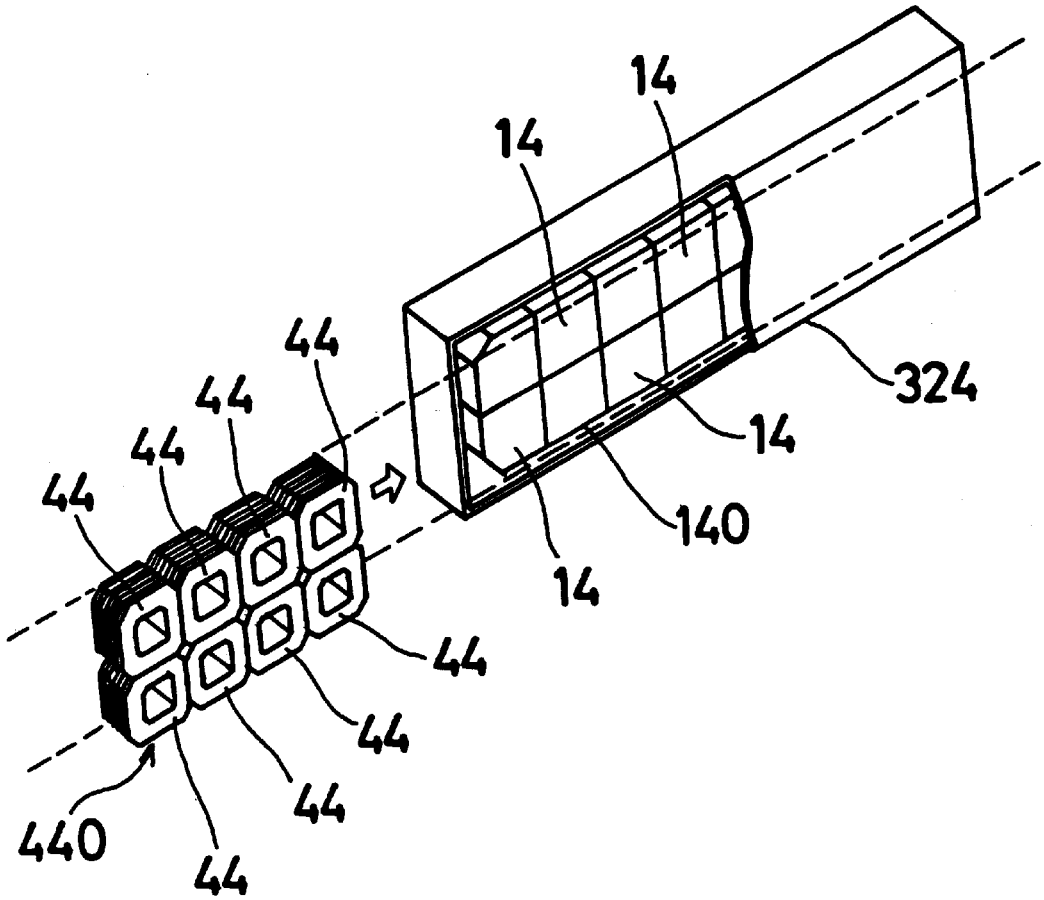
FIG. 33 illustrates a procedure of magnetizing superconductors according to a twelfth embodiment.
Figure 34:
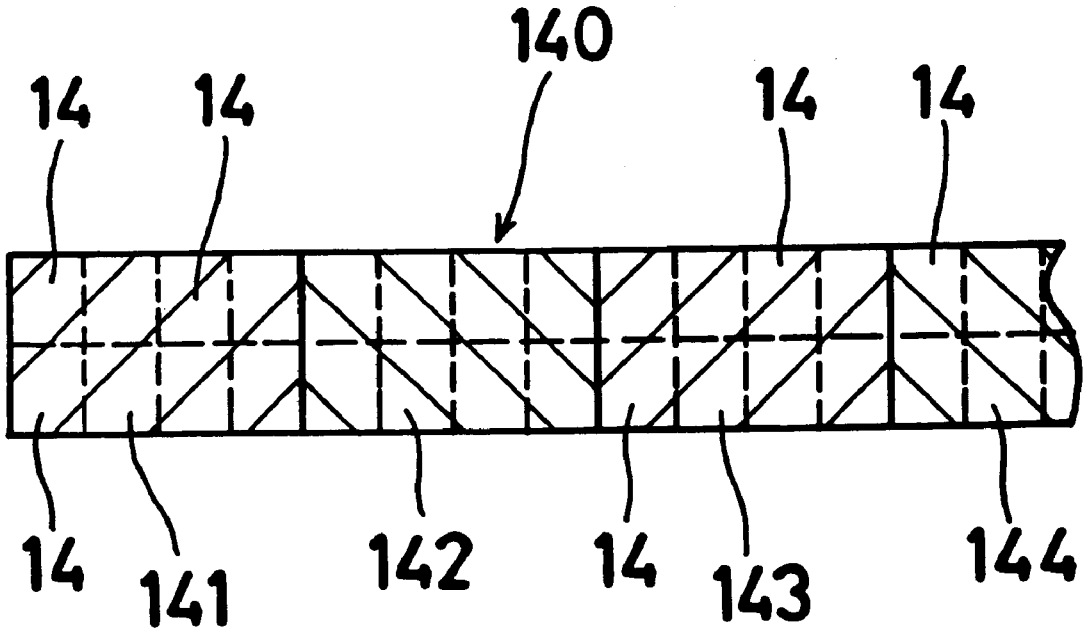
FIG. 34 illustrates domain division of a magnetization portion of a superconductor according to the twelfth embodiment.

Referring to FIG. 33, a long superconductor 140 is an assembly of square-shaped unit superconductors 14 arranged in two long rows. The superconductor 140 is disposed inside a long insulating container 324. The superconductor 140 is cooled to its superconduction transition temperature $T_c$ or lower by a cooling device (not shown).

A magnetizing coil assembly 440 is formed of eight small magnetizing coils 44 in an arrangement of 2 rows by 4 columns as shown in FIG. 33. The magnetizing coils have a size comparable to that of the unit superconductors 140. The magnetizing coils 44 are arranged so that all the magnetizing coils 44 produce pulsed magnetic fields with the same polarity.

For magnetization of the superconductor 140, the unit superconductors 14 are divided into blocks 141, 142, 143, .

. . , each block formed of eight unit superconductors 14 in an arrangement of 2 rows by 4 columns. One block of superconductors 14 corresponds to the size that can be magnetized by the magnetizing coil assembly 440 in a single magnetizing operation.

The magnetizing coil assembly 440 is translationally shifted sequentially to blocks 141, 142, . . . , and sequentially applies pulsed magnetic fields thereto. The superconductor 140 is thereby sequentially magnetized, thus producing a long superconducting magnet.

As understood from the above description, the long superconductor 14 can easily be magnetized using the compact magnetizing coil assembly 440 according to this embodiment. The superconducting magnet according to the embodiment can be applied to a magnetic field generator of a long shape used, for example, in a linear motor car. The magnetizing method according to the embodiment can also be employed to magnetize a superconductor that is not only long but also wide, using a compact magnetizing coil device. This embodiment thus makes it possible to expand the applicability of a superconducting magnet.

While the present invention has been described with reference to what is presently considered to be preferred embodiments thereof, it is to be understood that the invention is not limited to the disclosed embodiments or constructions. $T_0$ the contrary, the invention is intended to cover various modifications and equivalent arrangements included within the spirit and scope of the appended claims.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A superconducting magnet apparatus comprising:

a superconductor disposed in an insulating container;

a refrigerator having a cold head that thermally contacts the superconductor and cools the superconductor;

a magnetizing coil that applies a pulsed magnetic field to the superconductor;

energization means for energizing the magnetizing coil by a pulsed current;

a pulse power source that supplies the pulsed current to the magnetizing coil in order to apply the pulsed magnetic field to the superconductor; and control means for controlling the pulsed current such that a first pulsed magnetic field is applied to the superconductor element by supplying a magnetizing coil with a pulsed current whose peak value is controlled beforehand, thereby causing the superconductor element to capture a magnetic field, and at least a second pulsed magnetic field is applied to the superconductor element, thereby causing, after all of the at least second pulsed magnetic fields are applied, the superconductor element to capture an increased magnetic field in relation to the magnetic field captured after the first pulsed magnetic field is applied, wherein an intensity of successive pulsed magnetic fields applied to the superconductor element is equal to or less than that of a preceding pulsed magnetic field.

2. A superconducting magnet apparatus according to claim 1, wherein the magnetizing coil is disposed outside the insulating container.

3. A superconducting magnet apparatus according to claim 1, wherein the superconductor is a bulk superconductor formed from a RE—Ba—Cu—O material where RE indicates yttrium or other rare earth elements or a combination of any of these elements.

4. A superconducting magnet apparatus comprising:

a superconductor disposed in an insulating container;

cooling means for cooling the superconductor;

a magnetizing coil that applies a pulsed magnetic field to the superconductor, the magnetic coil being disposed outside the insulating container;

energization means for energizing the magnetizing coil by a pulsed current;

a pulse power source that supplies the pulsed current to the magnetizing coil in order to apply the pulsed magnetic field to the superconductor; and control means for controlling the pulsed current such that a first pulsed magnetic field is applied to the superconductor element by supplying a magnetizing coil with a pulsed current whose peak value is controlled beforehand, thereby causing the superconductor element to capture a magnetic field, and at least a second pulsed magnetic field is applied to the superconductor element, thereby causing, after all of the at least second pulsed magnetic fields are applied, the superconductor element to capture an increased magnetic field in relation to the magnetic field captured after the first pulsed magnetic field is applied, wherein an intensity of successive pulsed magnetic fields applied to the superconductor element is equal to or less than that of a preceding pulsed magnetic field.

* * * * *